US010093521B2

(12) United States Patent
King et al.

(10) Patent No.: US 10,093,521 B2
(45) Date of Patent: Oct. 9, 2018

(54) BARGE LID LIFTER SYSTEM AND METHOD

(71) Applicant: GREENFIELD PRODUCTS LLC, Hazel Crest, IL (US)

(72) Inventors: Robert Henry King, Martin, TN (US); Aaron Paul Miller, Martin, TN (US)

(73) Assignee: Greenfield Products LLC, Hazel Crest, IL (US)

( * ) Notice: Subject to any disclaimer, the term of this patent is extended or adjusted under 35 U.S.C. 154(b) by 0 days.

(21) Appl. No.: 15/496,711

(22) Filed: Apr. 25, 2017

(65) Prior Publication Data

US 2017/0313555 A1 Nov. 2, 2017

Related U.S. Application Data

(60) Provisional application No. 62/328,234, filed on Apr. 27, 2016.

(51) Int. Cl.

| | |
|---|---|
| ***B66C 1/28*** | (2006.01) |
| ***B66C 1/62*** | (2006.01) |
| *B63B 19/14* | (2006.01) |

(52) U.S. Cl.

CPC ..... *B66C 1/28* (2013.01); *B66C 1/62* (2013.01); *B63B 19/14* (2013.01)

(58) Field of Classification Search

CPC ..... B66C 1/101; B66C 1/223; B66C 1/28; B66C 1/663; B66C 1/62; B65D 88/126; B63B 19/14

USPC ..... 294/67.3, 67.32, 67.33, 81.5, 81.52, 294/81.53, 81.54, 81.6, 81.61, 81.62

See application file for complete search history.

(56) References Cited

U.S. PATENT DOCUMENTS

| | | | | | |
|---|---|---|---|---|---|
| 3,148,909 | A * | 9/1964 | Tantlinger | B65D 90/0026 | 24/600.7 |
| 3,892,436 | A * | 7/1975 | Fathauer | B66C 1/663 | 24/590.1 |
| 3,983,926 | A * | 10/1976 | Muller | B22C 21/08 | 164/386 |
| 4,396,218 | A * | 8/1983 | Stevens | B66C 1/663 | 294/81.41 |
| 4,521,044 | A * | 6/1985 | Appleman | B66C 1/663 | 294/81.1 |
| 4,563,031 | A * | 1/1986 | Kishimoto | B66C 1/62 | 294/81.21 |
| 5,127,695 | A * | 7/1992 | Zoeten | B66C 1/24 | 294/119.1 |

(Continued)

*Primary Examiner* — Dean J Kramer

(74) *Attorney, Agent, or Firm* — McCracken & Gillen LLC

(57) ABSTRACT

A barge lid lifter system having a horizontal frame, a plurality of vertical beams, a plurality of cross bracing beams, and a plurality of load engagement mechanisms is provided. Each load engagement mechanism may include a frame, wherein each load engagement mechanism frame may have a first side plate, a second side plate, a top plate, a dagger plate, a horizontal pivot pin, and a horizontal pivot pin sleeve. The load engagement mechanism includes a linear actuator, a rotation plate, a rotation elbow, an arm, and a dagger point. The linear actuator is connected to the first side plate and the rotation elbow, and the rotation plate is connected to the rotation elbow and the arm. The arm is configured to close over the dagger point and retain a lifting eye of a barge lid lifting assembly.

20 Claims, 22 Drawing Sheets

(56) References Cited

U.S. PATENT DOCUMENTS

| | | | | |
|---|---|---|---|---|
| 5,163,726 | A * | 11/1992 | Boos | B66C 1/663 294/67.1 |
| 6,863,325 | B1 * | 3/2005 | Mills | B66C 1/663 294/81.21 |
| 7,240,936 | B2 * | 7/2007 | Petzitillo, Jr. | B65D 88/121 294/81.53 |
| 8,556,312 | B2 * | 10/2013 | Hellgren | B66C 1/101 294/81.1 |
| 9,434,580 | B2 * | 9/2016 | Bakalyar | B66C 1/12 |

* cited by examiner

BARGE LID LIFTER SYSTEM AND METHOD

CROSS REFERENCE TO RELATED APPLICATIONS

The present application claims the benefit of U.S. Provisional Application No. 62/328,234, filed Apr. 27, 2016, entitled "Barge Lid Lifter System and Method", the entire contents of which is incorporated herein by reference.

FIELD OF THE DISCLOSURE

The present subject matter generally relates to lifting systems used in connection with barges or other freight transportation vehicles and, more particularly to lifting systems used to acquire loads during the loading, offloading, transport, and storage of freight on canal and river barges.

BACKGROUND

Improving the safety of the transport of freight on waterways remains an area of interest. Some existing systems have various shortcomings relative to certain applications. Specifically, existing technology requires dock workers to reach over water to secure and release lifting equipment to and from barge lids. This type of activity presents a certain amount of safety risk in the shipping industry. Accordingly, there remains a need for further contributions in this area of technology.

SUMMARY

According to one aspect, a barge lid lifter system is provided having a horizontal frame, communication equipment indication lights mounted to the horizontal frame, a plurality of vertical beams connected to the horizontal frame, and load engagement mechanisms mounted on the vertical beams. The load engagement mechanisms are configured to retain a lifting eye of a barge lid lifting assembly using a linear actuator, an arm, and a dagger point.

According to another aspect, a load engagement mechanism that is mounted on a vertical beam is provided. The load engagement mechanism has a frame comprising a first side panel, a second side panel, a top plate, a dagger plate, a horizontal pivot pin, and a horizontal pivot pin sleeve. The load engagement mechanism has a linear actuator configured to position an arm over a dagger point on the dagger plate.

According to another aspect, a method of lifting a barge lid is provided. The barge lid lifter system is landed onto a barge lid. The barge lid lifter system may have an upper frame and a lower frame. The lower frame has a plurality of load engagement mechanisms, and a plurality of lifting eyes of the barge lid are positioned between the dagger point and the arm of each of the plurality of load engagement mechanisms. Each of the plurality of barge lid lifting eyes are latched such that each of the arms of the load engagement mechanisms close over each of the dagger points to retain the lifting eyes of the barge lid.

DETAILED DESCRIPTION

Figure 1:
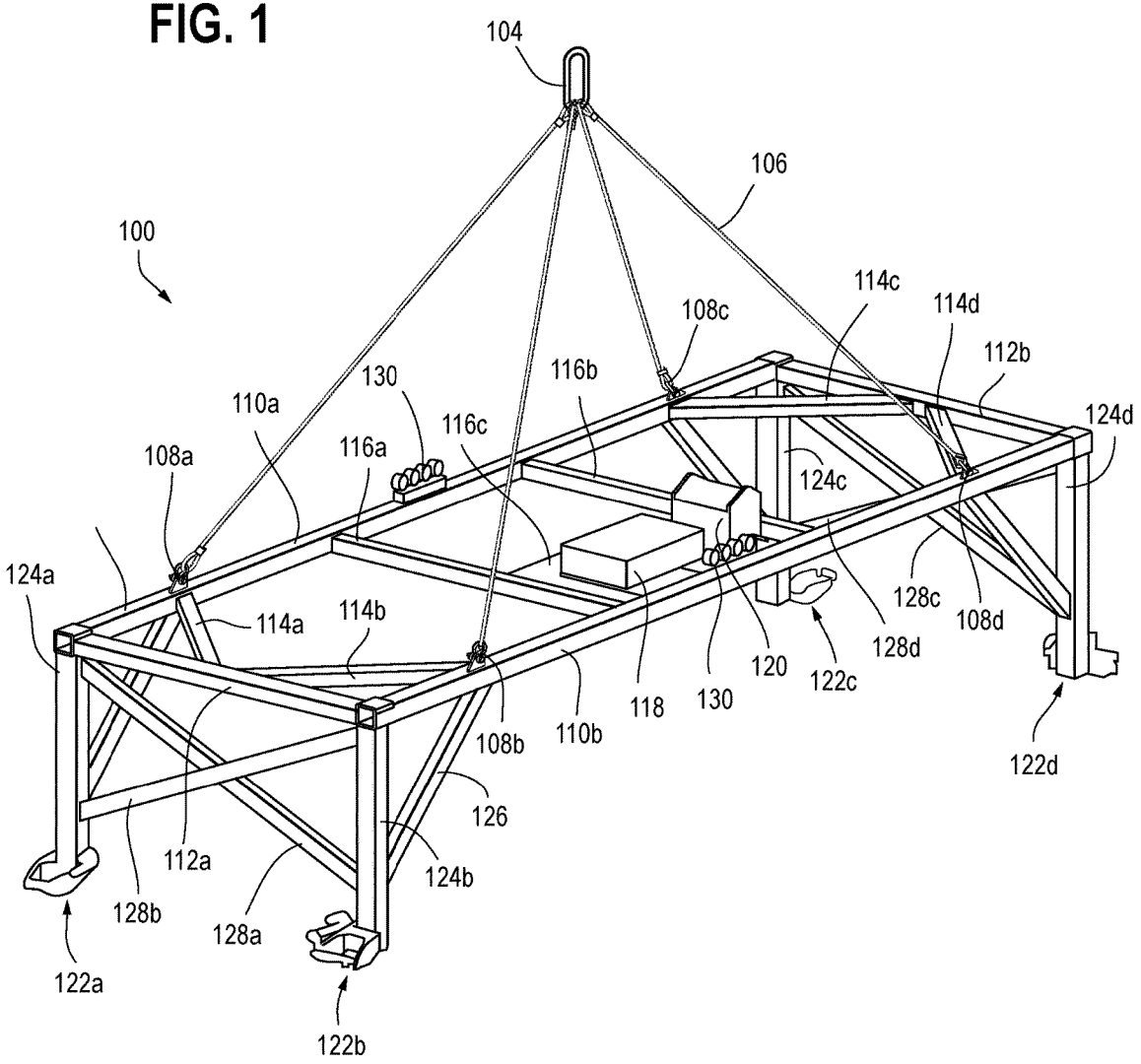
FIG. 1 depicts a perspective view of a first embodiment of a barge lid lifter system.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended. Any alterations and further modifications in the described embodiments, and any further applications of the principles as described herein are contemplated as would normally occur to one skilled in the art to which the subject matter of the disclosure relates.

It is necessary to remove and reposition barge lids during loading and offloading of river barge freight. The barge lid lifter system allows workers on shore to land load engagement mechanisms onto a barge lid, acquire lifting hooks, and lift the barge lid off the barge, remotely. It is possible to minimize situations in which workers are required to climb or reach onto the barge by providing a remote communication system that allows the barge lid lifter system to verify that load engagement mechanisms are landed on a barge lid and latched onto barge lid lifting eyes. Less workers climbing onto barges to attach and release barge lids from lifting equipment will increase safety and result in a more efficient process of loading and offloading river barge freight.

Referring to FIG. 1, an example embodiment of a barge lid lifter system 100 is shown with a horizontal frame 102 connected to an oblong link 104 using a cable bridle 106. The oblong link 104 can be attached to a crane hook (not shown) or other lifting means. The illustrated embodiment shows cable anchor points 108*a*, 108*b*, 108*c*, 108*d* attached to the horizontal frame 102. The oblong link 104 is configured to accept a hook suspended from a crane or an overhead hoist. Alternate embodiments may include a frame with different anchor points configured to accept plate lifters, grapplers, container spreaders and other lifting systems for lifting balanced or unbalanced loads when weight is distributed over several points.

The horizontal frame 102 includes two side beams 110*a*, 110*b* and two end beams 112*a*, 112*b*. Horizontal corner bracing beams 114*a*-114*d* provide support between the side beams and end beams, and horizontal side bracing beams 116*a*-116*c* are provided between the side beams 110*a*, 110*b*. A first housing 118 and a second housing 120 are mounted between horizontal side bracing beams 116*a*-116*c* of the horizontal frame 102. The first housing 118 contains a remote transmitter control system and is preferably watertight to protect the remote transmitter control system from the elements. The remote transmitter control system includes relays, a programmable logic controller (PLC), radio communication equipment, and wiring. The second housing 120 contains a battery system to power the remote transmitter control system and the load engagement mechanisms 122*a*-122*d* of the barge lid lifter system 100. Other means of providing power to the barge lid lifter system 100 may include pneumatic power, hydraulic power, and mechanical power.

Indication lights 130 are provided on the sides and/or ends of the horizontal frame 102 to communicate the status of the load engagement mechanisms 122*a*-122*d* to crane operators, dock workers, and others working on land.

Four vertical beams 124*a*-124*d* are mounted on the four corners of the horizontal frame 102. A load engagement mechanism 122 is mounted to the bottom of each vertical beam 124.

Vertical corner bracing beams 126*b*, 126*d* are provided between the vertical beams 124*b*, 124*d* and the side beam 110*b* of the horizontal frame 102. Vertical cross bracing beams 128*a*-128*d* are installed diagonally between vertical beams 124*a*-124*d* to provide structural support on the ends of the horizontal frame 102.

Figure 2:
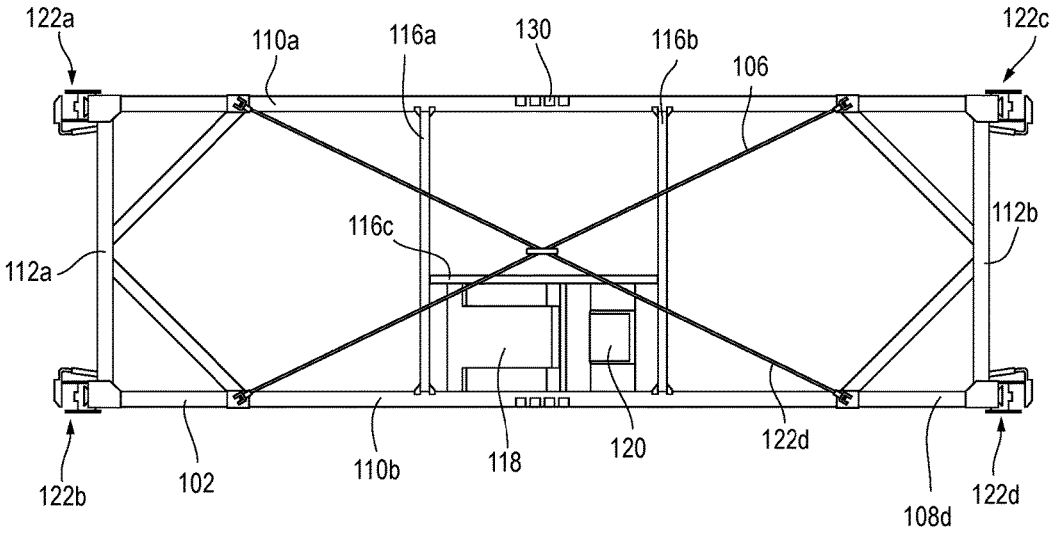
FIG. 2 depicts a top view of the barge lid lifter system of FIG. 1.

Referring to FIG. 2, a top view of the barge lid lifter system 100 is shown. The horizontal frame 102 has a rectangular shape comprising two side beams 110*a*, 110*b* and two end beams 112*a*, 112*b*. The load engagement mechanisms 122*a*-122*d* are located below each corner of the horizontal frame 102.

Figure 3:
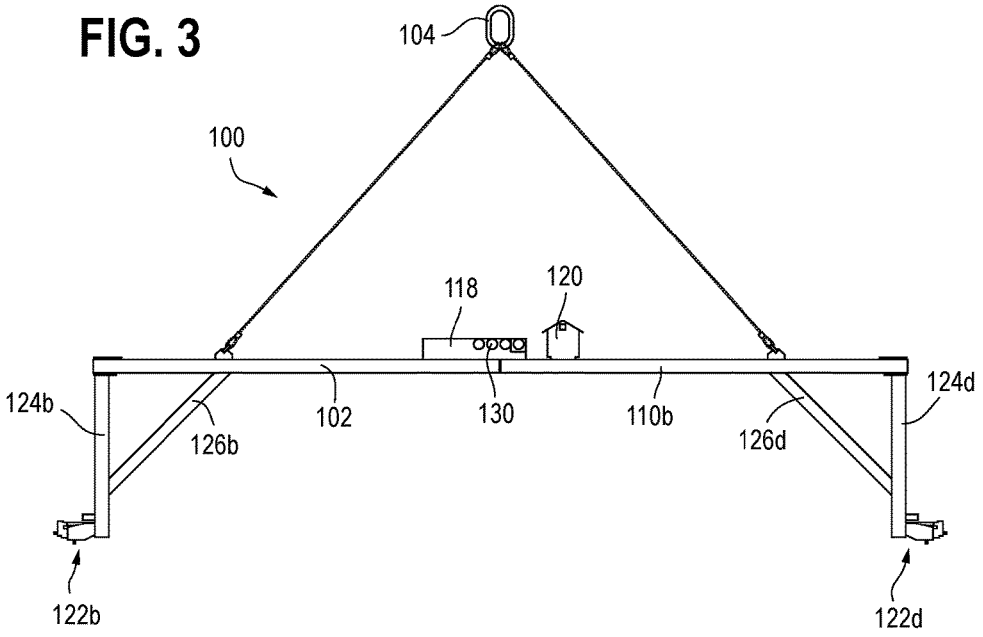
FIG. 3 depicts a side view of the barge lid lifter system.

Referring to FIG. 3, a side view of the barge lid lifter system 100 is shown. The first housing 118 and second housing 120 are mounted above the horizontal frame 102. Power cables and communication wiring (not shown) are run between the first housing 118, the second housing 120, and the load engagement mechanisms 122*a*-122*d*.

Figure 4:
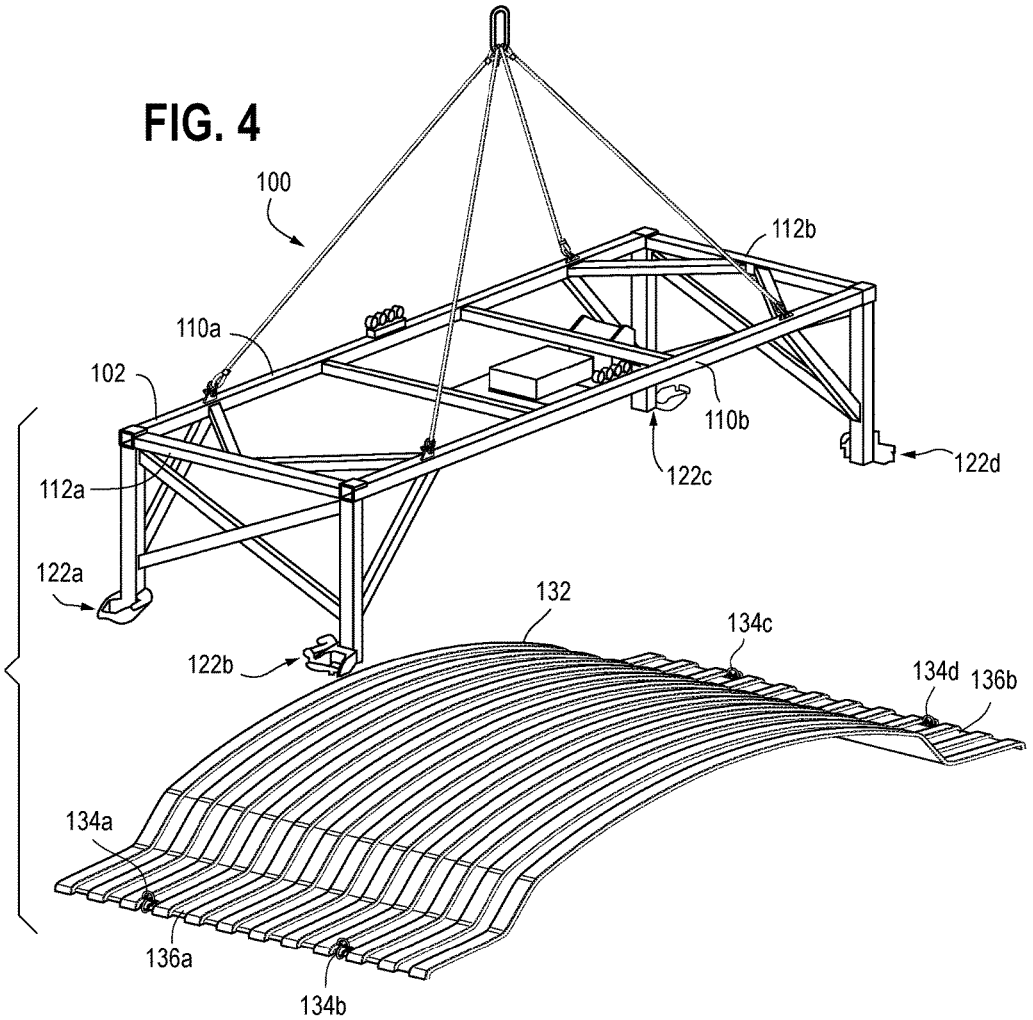
FIG. 4 depicts a perspective view of the barge lid lifter system above a barge lid.

Referring to FIG. 4, the barge lid lifter system 100 is positioned over a barge lid 132. The barge lid 132 is made of fiberglass and is lifted using four lifting assemblies 134*a*-134*d* positioned at either edge 136*a*, 136*b* of the barge lid 132. The horizontal frame 102 is designed to engage each of the four lifting assemblies 134*a*-134*d*. The side beams 110*a*, 110*b* are approximately 30 feet long and the end beams 112*a*, 112*b* are approximately 9 feet long. An operator uses a crane to position the barge lid lifter system 100 so that the load engagement mechanisms 122*a*-122*d* are positioned over each of the barge lid lifting assemblies 134*a*-134*d* located on either edge 136*a*, 136*b* of the barge lid 132. Once in position, an operator will verify the status of the load engagement mechanisms 122*a*-122*d*. The worker may lower the barge lid lifter system 100 down onto the barge lid 132 once all four of the load engagement mechanisms 122*a*-122*d* are verified to be in the unlatched position.

Tag lines, as may be required by the Occupational Safety and Health Administration, may be attached to the horizontal frame 102 to allow workers to guide the barge lid lifter system 100 as it is lowered into place. Additionally or alternatively, a removable guide system may be provided on the horizontal frame 102. The removable guides may be bolted onto and extend outward from the horizontal frame 102 to align the barge lid lifter system 100 with the sides 152, 154 of a barge 150.

Figure 5:
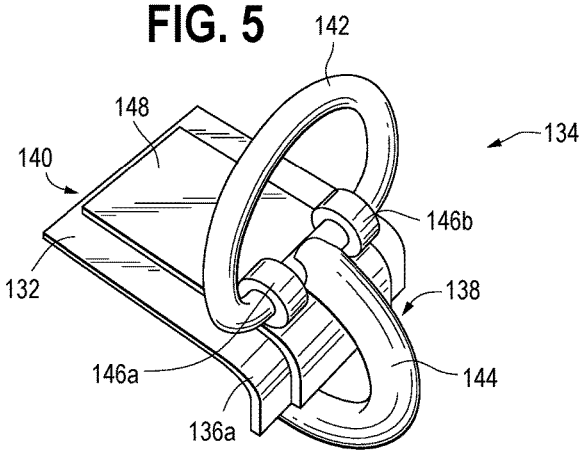
FIG. 5 depicts a perspective view of a barge lid lifting assembly.

Referring to FIG. 5, a perspective view of a barge lid lifting assembly 134 is shown with a portion of barge lid 132. Each lifting assembly 134 has a movable portion 138 and a fixed portion 140. The movable portion 138 includes a lifting eye 142 (or bail) attached to a clamp portion 144. The movable portion 138 is rotatably secured to the fixed portion 140 by two eyelets 146*a*, 146*b*. The fixed portion 140 includes an upper plate 148 and a bottom plate (not shown) that are bolted or otherwise affixed to the barge lid 132. A locator pin (not shown) extends from the bottom plate.

The clamp portion 144 of the barge lid lifting assembly 134 retains a flange on the side wall of a barge. To remove the barge lid 132, the lifting eye 142 is rotated away from the edge 136*a* of the barge lid 132 to raise the clamp portion 144. Barge lids having lifting assemblies with a lifting eye and a clamp portion may be sold by certain manufacturers such as Trinity Marine Products, Inc. of Dallas, Tex.

Figure 6:
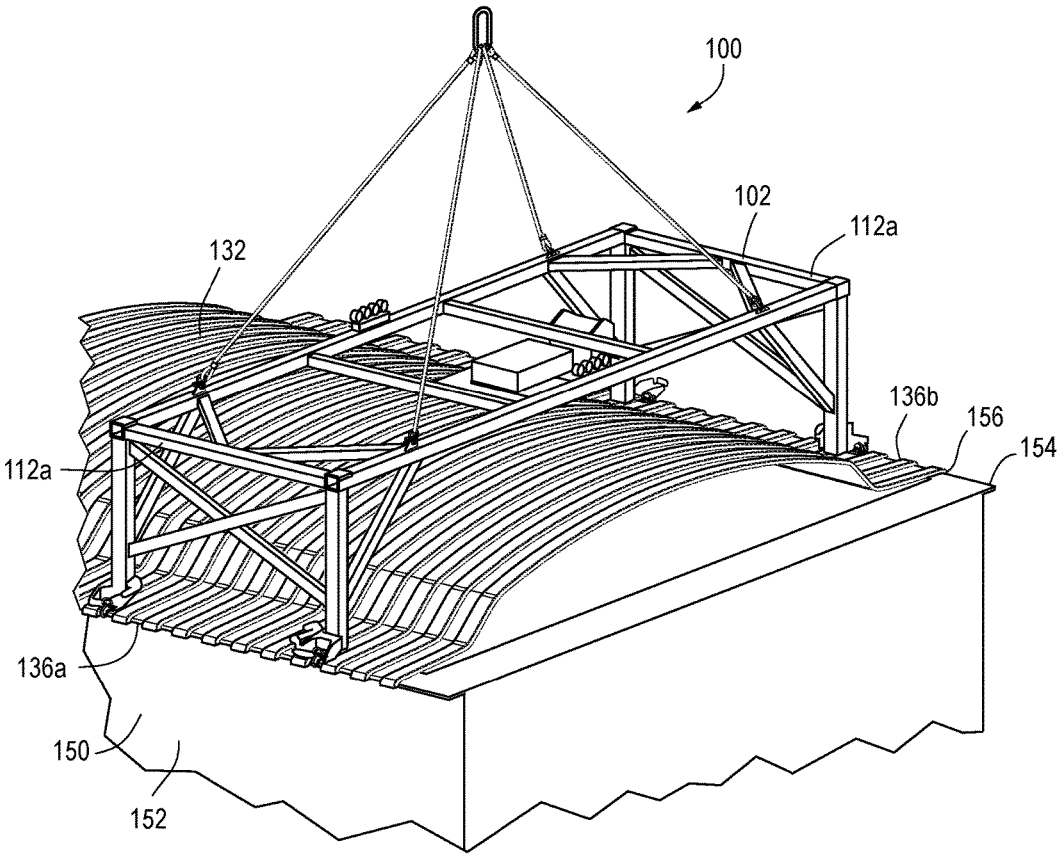
FIG. 6 depicts a perspective view of the barge lid lifter system that has landed on a barge lid.

Referring to FIG. 6, the barge lid lifter system 100 is shown landed and unlatched on a barge lid 132. When a barge 150 is docked, a first end 112*a* of the horizontal frame 102 is positioned at a dock side 152 of the barge lid 132, and a second end 112*b* of the horizontal frame 102 is positioned at a far side 154 of the barge lid 132.

Figure 7:
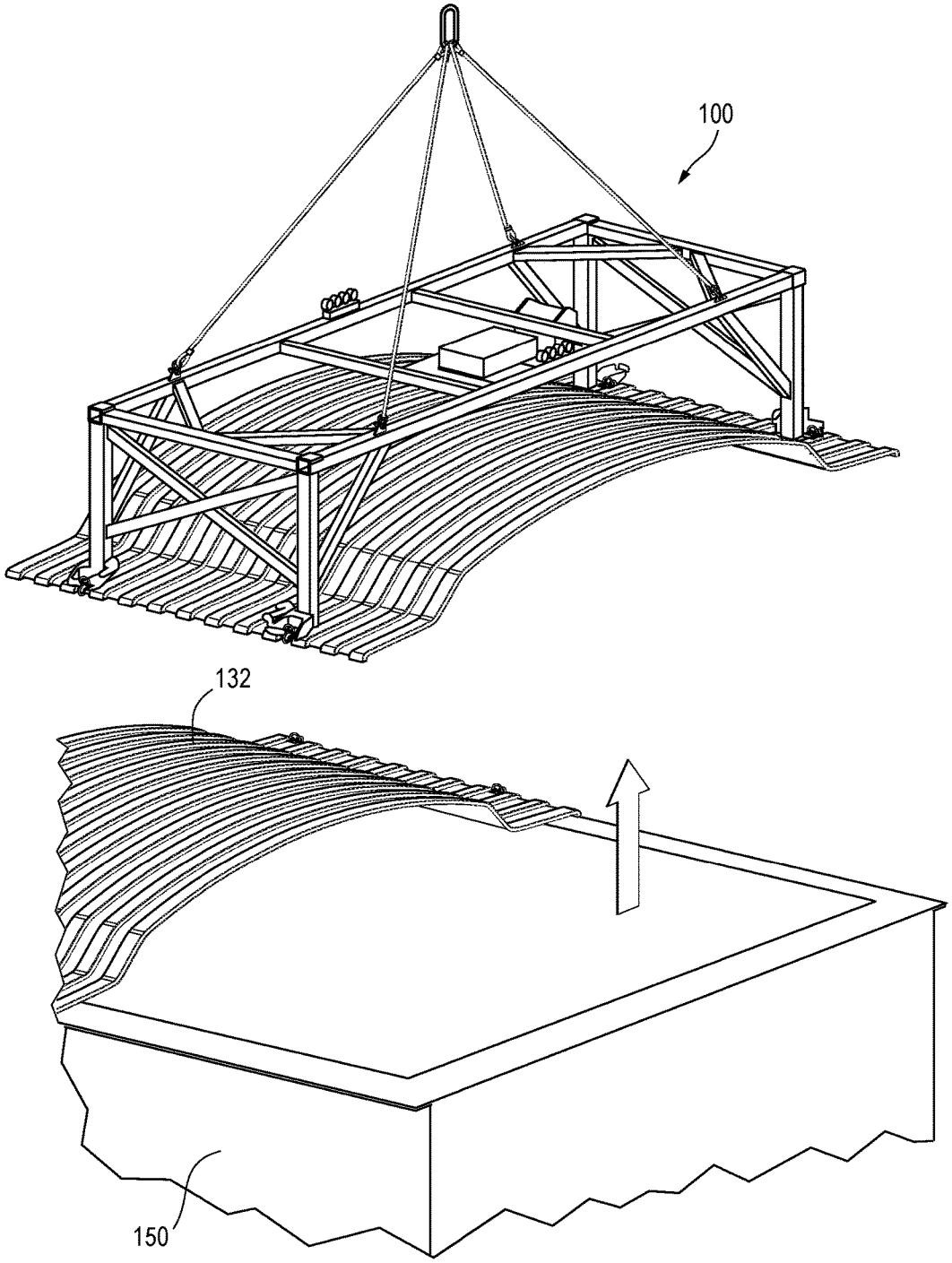
FIG. 7 depicts a perspective view of the barge lid lifter system lifting the barge lid.

Referring to FIG. 7, after the load engagement mechanisms 122*a*-122*d* of the barge lid lifter system 100 engage the barge lid lifting assemblies 134*a*-134*d* (FIG. 4), the barge lid lifter system 100 and the barge lid 132 are lifted off of the barge 150 by a crane (not shown).

Figure 8:
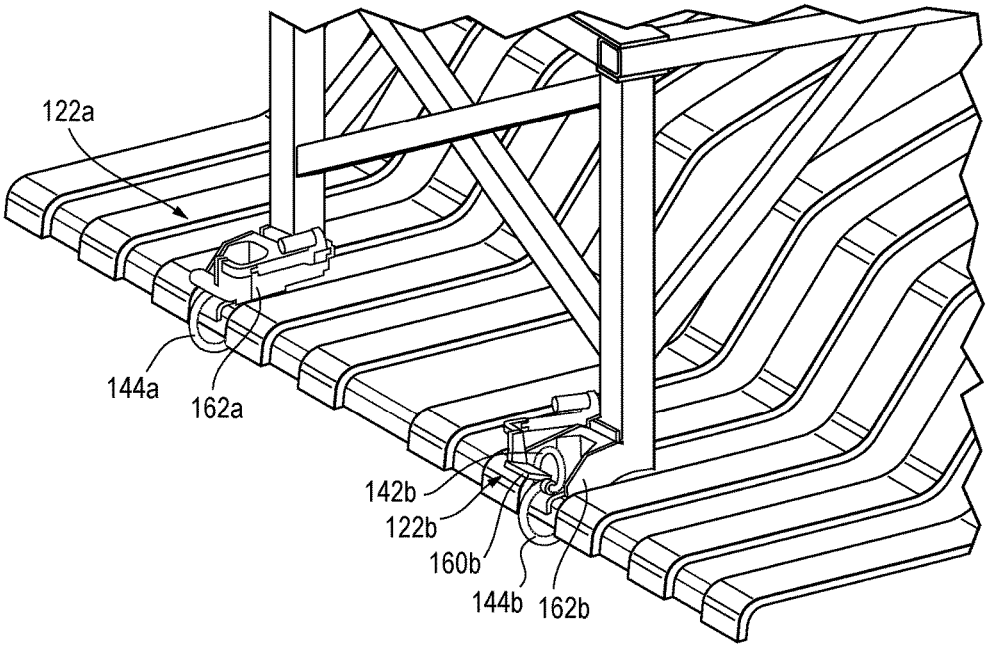
FIG. 8 depicts a partial cut-away perspective view of the barge lid lifter system landed on a barge lid.

Referring to FIG. 8, the load engagement mechanisms 122*a*, 122*b* are landed on the barge lid lifting assemblies 134*a*, 134*b* such that each lifting eye 142*a*, 142*b* is positioned between the arm 160*a*, 160*b* and the mechanism frame 162*a*, 162*b* of each load engagement mechanism 122*a*, 122*b*.

Figure 9:
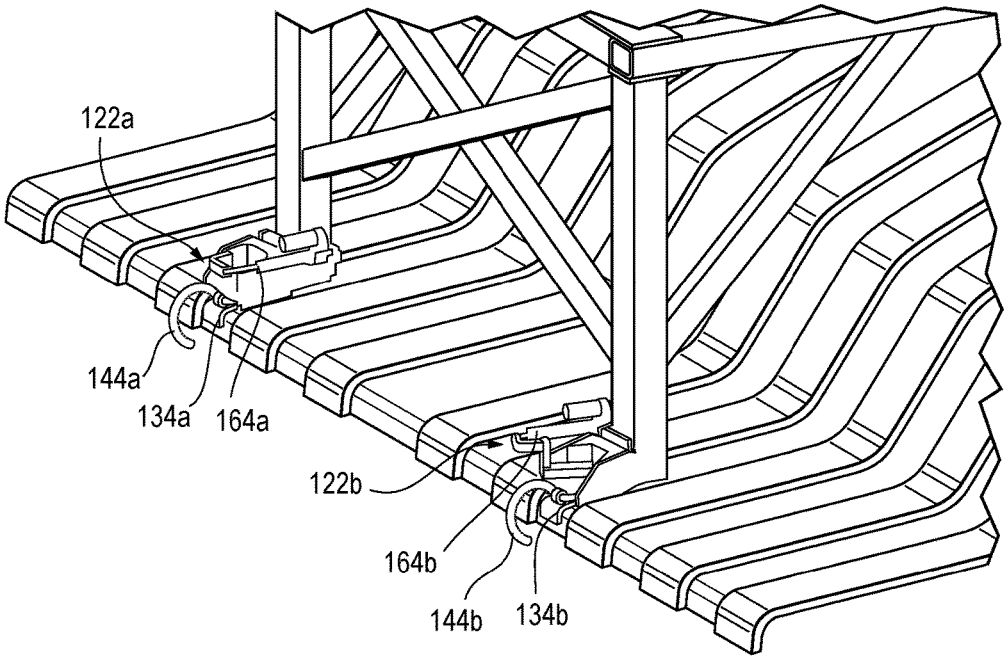
FIG. 9 depicts a partial cut-away perspective view of the barge lid lifter system in which load engagement mechanisms are landed and latched on a barge lid lifting assembly.

Referring to FIG. 9, each of the load engagement mechanisms 122*a*, 122*b* comprises a linear actuator 164*a*, 164*b* that extends to retain the lifting eye 142*a*, 142*b* (not shown) and raise the clamp portion 144*a*, 144*b* of each barge lid lifting assembly 134*a*, 134*b*.

Figure 10:
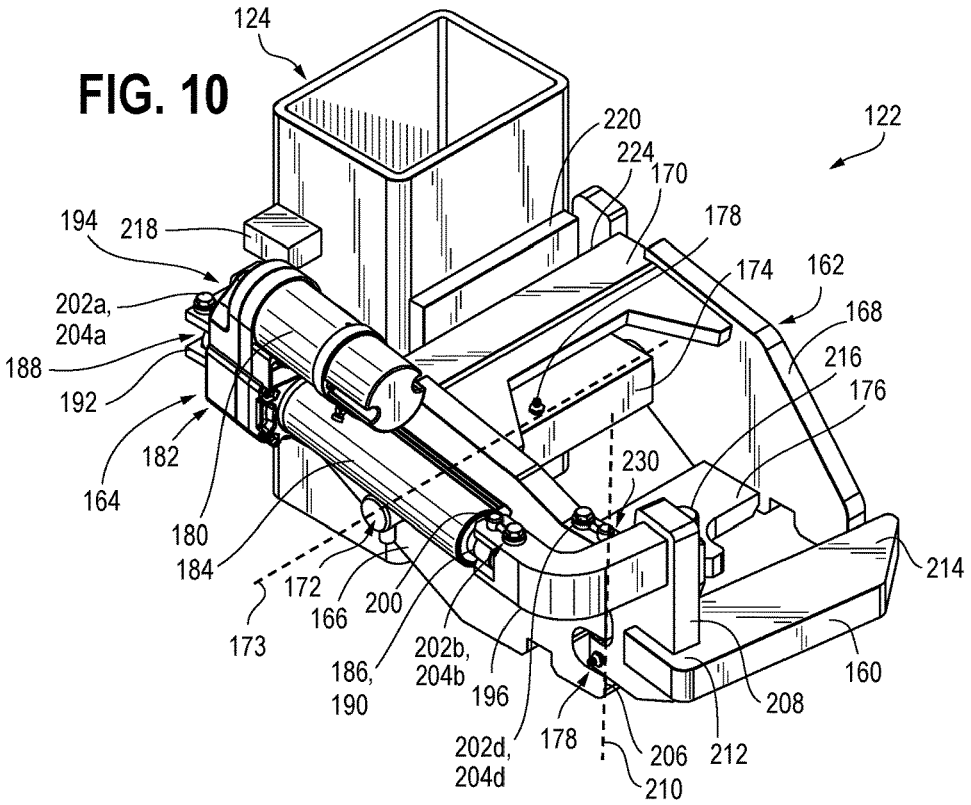
FIG. 10 depicts a perspective view of an embodiment of a load engagement mechanism of the barge lid lifter system.

Referring to FIG. 10, a load engagement mechanism 122 is shown having a mechanism frame 162 attached to a vertical beam 124. The mechanism frame 162 of the load engagement mechanism 122 in this example embodiment includes a first side plate 166, a second side plate 168, a top plate 170, a horizontal pivot pin 172, a horizontal pivot pin sleeve 174, and a dagger plate 176. The first side plate 166 and second side plate 168 are welded to the top plate 170 and the dagger plate 176. The horizontal pivot pin 172 extends between the first side plate 166 and the second side plate 168 and is retained in a horizontal pivot pin sleeve 174 that is welded to the vertical beam 124. A grease fitting 178 is provided on the horizontal pivot pin sleeve 174 to lubricate the horizontal pivot pin 172. The components comprising the mechanism frame 162 of the load engagement mechanism 122 may be constructed of a high-strength low carbon alloy steel such as A572.

The linear actuator 164 is provided having a communication portion 180, an electric motor 182, a cylinder 184, a shaft 186, a rear portion 188, and a forward portion 190. The rear portion 188 of the linear actuator 164 is mounted to the first side plate 166 at a rear bracket 192 using a rear pin 194, and the forward portion 190 of the shaft 186 of the linear actuator 164 is mounted to a rotation elbow 196 at a forward bracket 198 using a forward pin 200. The forward pin 200 and rear pin 194 are held in place by ring pins 202*a*, 202*b* and bolts 204*a*, 204*b*. Pins used throughout this embodiment of the load engagement mechanism 122 are constructed of a general purpose low carbon steel alloy such as C1018.

The linear actuator 164 is powered by the battery system and controlled by the remote transmitter control system mounted on the horizontal frame 102 of the barge lid lifter system 100. A command is generated remotely by a dock worker or crane operator that is received by the radio transmitter control system. The linear actuator 164 contains internal limit switches used to determine the status of the shaft 186 of the linear actuator 164 and communicates with the PLC. The PLC controls the indication lights 130 on the horizontal frame 102 that are viewed by the crane operator and other workers on land.

The first side panel 166 of the load engagement mechanism 122 includes a vertical hinge 206 at a forward end. The vertical hinge 206 secures a rotation plate 208 to the first side plate 166 and allows the rotation plate 208 to turn about a vertical axis 210. The rotation elbow 196 is connected to the forward portion 190 of the shaft 186 of the linear actuator 164 and is welded to the rotation plate 208. The arm 160 is welded to the rotation plate 208 at a first end 212 and has a second end 214 that extends horizontally outward. The second end 214 of the arm 160 extends toward the second side plate 168 in the unlatched position. When the shaft 186 of the linear actuator 164 extends, the shaft 186 moves forward in the cylinder 184 and causes the rotation plate to rotate about the vertical hinge 206. As the rotation plate 208 turns, the second end 214 of the arm 160 moves over the dagger point 216 and toward the vertical beam 124.

In the illustrated embodiment, the shaft 186 of the linear actuator 164 is about 6 inches long and may extend about 4 to 5 inches from the unlatched position to the latched position. In other embodiments the shaft 186 of the linear actuator 164 may extend only about 3 inches or greater than about 5 inches to reach a latched position. In other embodiments the extension of the linear actuator 164 may be accomplished using the electric motor 182 or the linear actuator may comprise a means for extending such as, a hydraulic cylinder, a pneumatic cylinder, a voice coil (electric cylinder) or a linear motor (linear magnetic actuator using electromagnets).

One or more blocks 218 are attached to the vertical beam 124 to act as stops. The block 218 contacts the first side panel 166 when the load engagement mechanism 122 is unlanded. A gap (not shown) exists between the block 218 and the first side panel 166 when the load engagement mechanism 122 is landed on a barge lid 132 or when the weight of the mechanism frame 162 is otherwise supported from below rather than hanging from the vertical beam 124 (such as when sitting on the ground).

A vertical plate 220 is attached to the vertical beam 124. A gap 222 exists between the vertical plate 220 and a rear surface 224 of the top plate 170 when the load engagement mechanism 122 is unlanded. As the weight of the load engagement mechanism 122 is supported by the barge lid lifting assembly 134, the mechanism frame 162 pivots on the horizontal pivot pin 172 about a horizontal axis 173, and the vertical plate 220 contacts the rear surface 224 of the top plate 170.

In the illustrated embodiment, the mechanism frame 162 pivots approximately 4 to 8 degrees on the horizontal pivot pin 172 about the horizontal axis 173 from the unlanded position to the landed position. In other embodiments the mechanism frame 162 may pivot approximately 2 to 3 degrees or greater than approximately 8 degrees from an unlanded to a landed position (as the top plate 170 contacts the vertical plate 220). Preferably, the frame rotates between about 1 degree and about 45 degrees, more preferably, the frame rotates between about 3 degrees and about 30 degrees, and most preferably, the frame rotates between about 4 degrees and about 15 degrees. In other embodiments the thickness and/or location of the one or more blocks 218 and the thickness and/or location of the vertical plate 220 may be adjusted to increase or decrease the amount of rotation about the horizontal axis 173 between the landed and unlanded positions.

Figure 11:
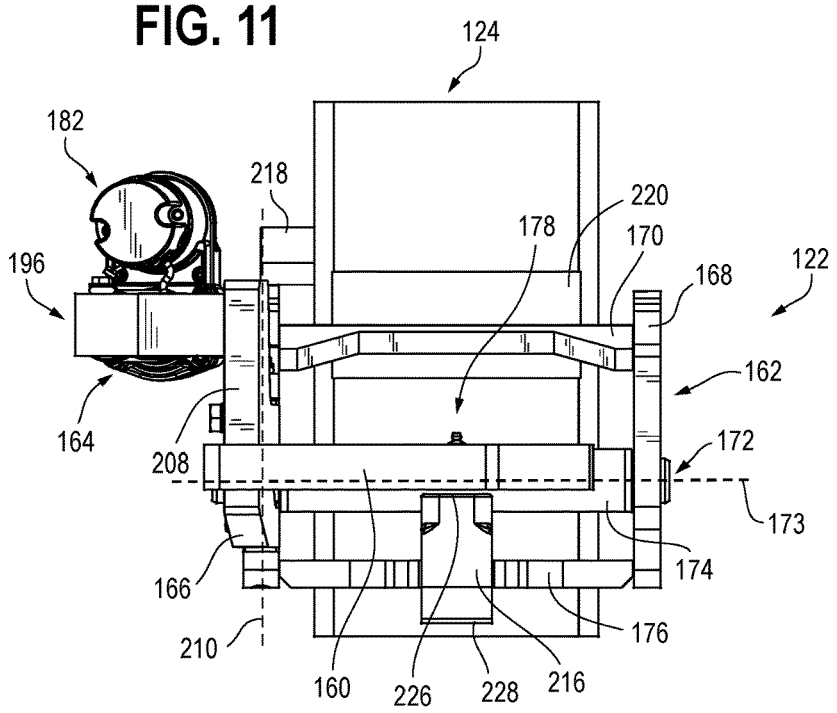
FIG. 11 depicts a front view of a load engagement mechanism of FIG. 10.

Referring to FIG. 11, the dagger point 216 is mounted to the dagger plate 176 and has a flat, top surface 226 that extends above the dagger plate 176 and has a non-flat, lower surface 228 that extends below the dagger plate 176. The dagger point 216 may, for example, be constructed from a high strength steel alloy such as A514 (sold as T-1™ by ArcelorMittal).

Figure 12:
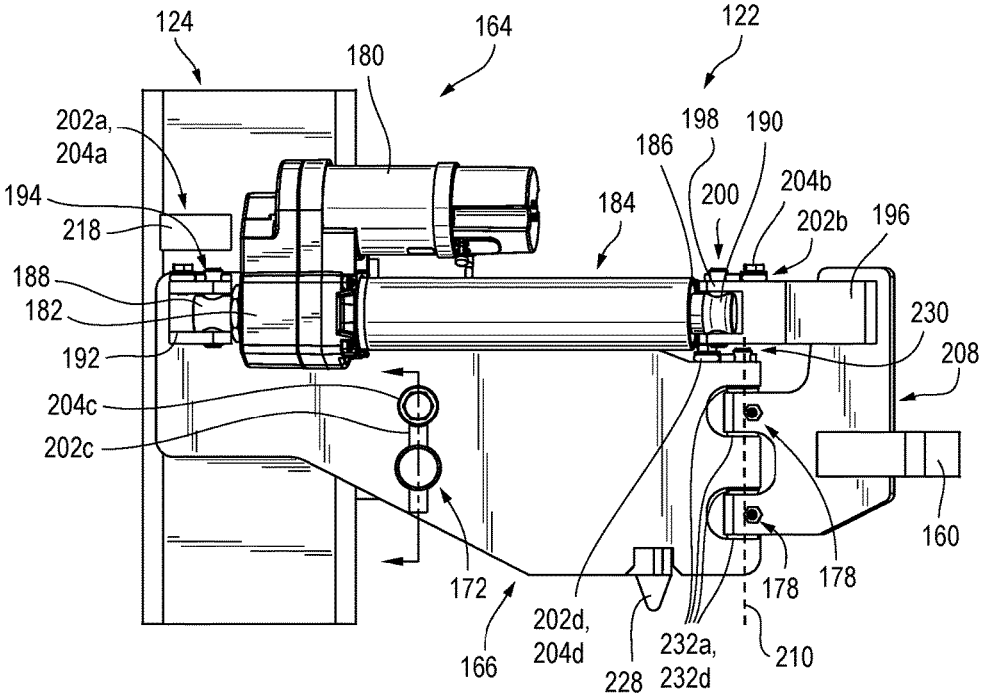
FIG. 12 depicts a side view of the load engagement mechanism of the barge lid lifter system.

Referring to FIG. 12, the first side plate 166 of the load engagement mechanism 122 has a rear bracket 192 that engages the rear portion 188 of the linear actuator 164 via a rear pin 194. The horizontal pivot pin 172 is retained in the first side plate 166 using a bolt 202*c* and a ring pin 204*c*. The non-flat, lower surface 228 of the dagger point 216 that extends below the first side plate 166 is useful for penetrating snow, ice, or any other debris that could be present on the top plate of a barge lid lifting assembly 134. The vertical hinge 206 allows the rotation plate 208 to rotate and thereby move the arm 160 between an unlatched position and a latched position. The vertical hinge 206 includes a hinge pin 230, held in place by a ring pin 202*d* and a bolt 204*d*, and a plurality of brass bushings 232*a*-232*d*.

Figure 13:
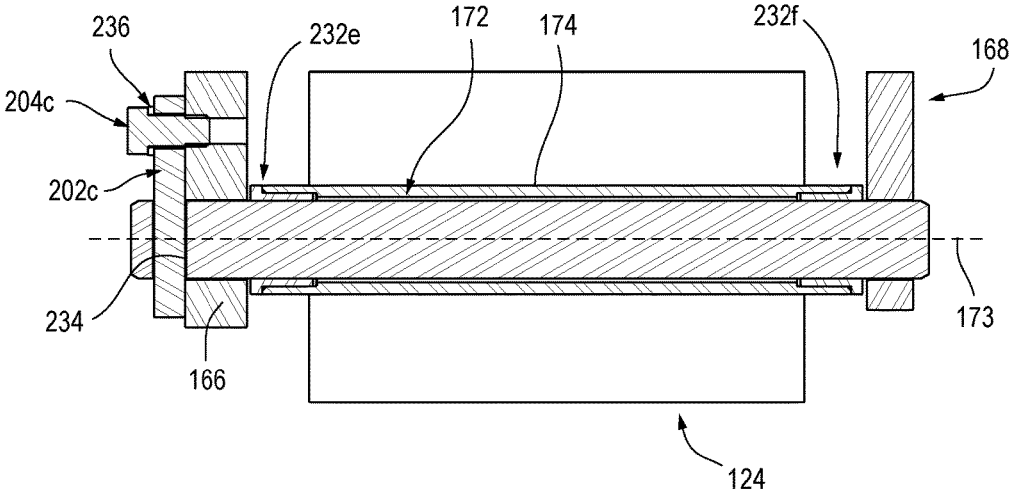
FIG. 13 depicts a sectional view of the load engagement mechanism of the barge lid lifter system along line A-A of FIG. 12.

Referring to FIG. 13, a sectional view along line A-A of FIG. 12 shows the horizontal pivot pin 172 retained in the first side panel 166 and the second side panel 168. A ring pin 202*c* (or eyebolt) extends through a shaft 234 in the horizontal pivot pin 172. The ring pin 202*c* is secured to the first side panel 166 by a bolt 204*c* and a washer 236. The horizontal pivot pin 172 is housed in a horizontal pivot pin sleeve 174 that extends between two bushings 232*e*, 232*f* that may come into contact with the first side panel 166 and the second side panel 168. The horizontal pivot pin sleeve 174 is permanently secured to the vertical beam 124 by welds or other means.

Figure 14:
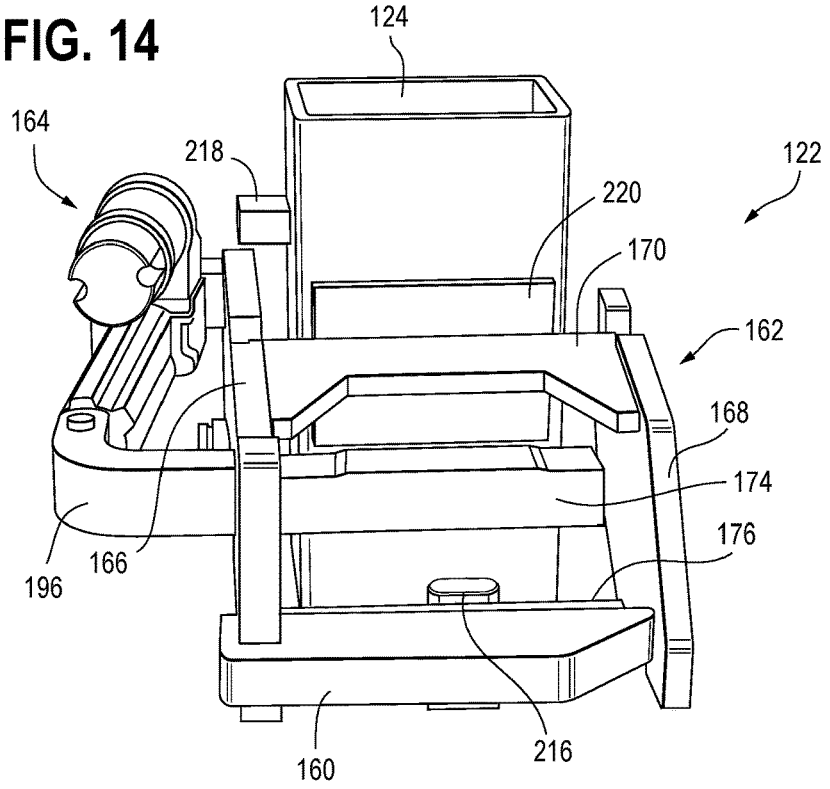
FIG. 14 depicts a front perspective view of the load engagement mechanism of the barge lid lifter system.

Referring to FIG. 14, when the load engagement mechanism 122 of the barge lid lifter system 100 is in an unlatched and unlanded position, the shaft 186 (not shown) of the linear actuator 164 is not extended, the arm 160 is substantially perpendicular to the second side plate 168, and the first side plate 166 is in contact with the block 218.

Figure 15:
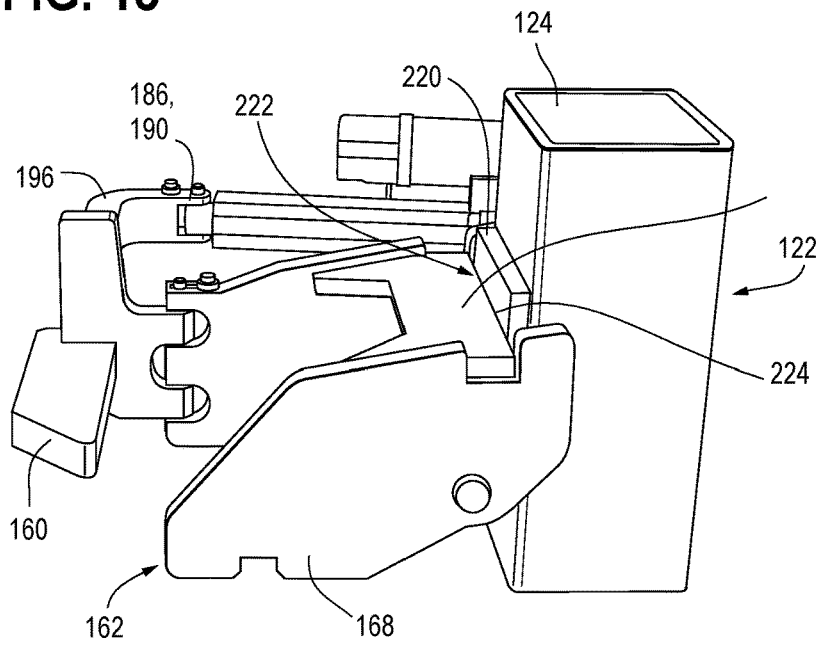
FIG. 15 depicts a side perspective view of the load engagement mechanism of the barge lid lifter system.

Referring to FIG. 15, when the load engagement mechanism 122 of the barge lid lifter system 100 is in an unlanded and unlatched position, a gap 222 exists between the top plate 170 of the mechanism frame 162 and the vertical plate 220 attached to the vertical beam 124.

Figure 16:
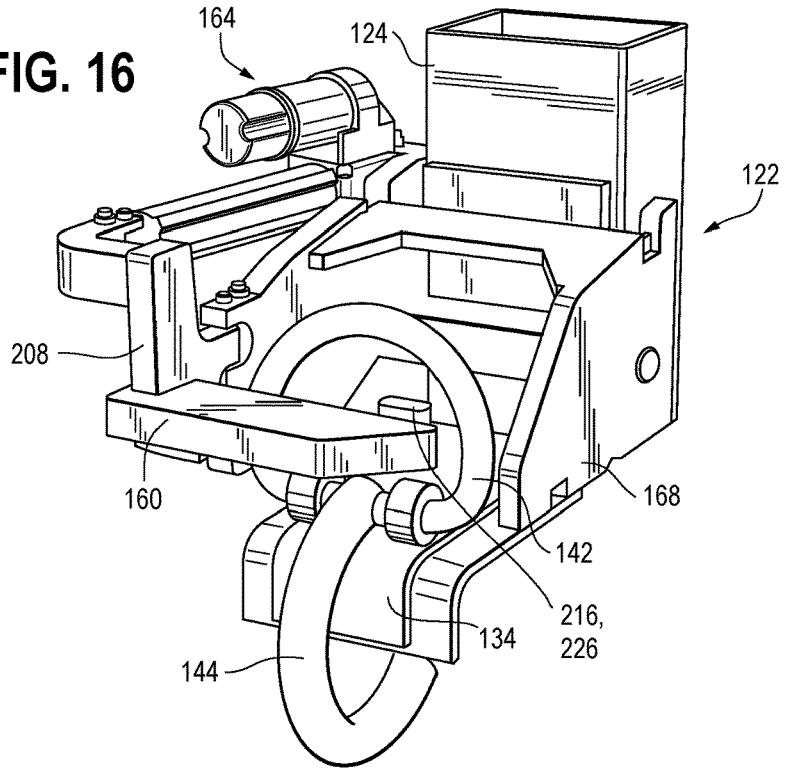
FIG. 16 depicts a perspective view of the load engagement mechanism of the barge lid lifter system in a landed and unlatched position from a barge lid lifting assembly.

Referring to FIG. 16, when the load engagement mechanism 122 of the barge lid lifter system 100 is in a landed and unlatched position, the shaft 186 of the linear actuator 164 is not extended, the rotation plate 208 is parallel to the first side plate 166, and the top plate 170 contacts the vertical plate 220. Only a portion of the barge lid 132 is shown in FIGS. 16-22 for the purpose of illustrating the interaction between the barge lid lifting assembly 134 and the load engagement mechanism 122.

Figure 17:
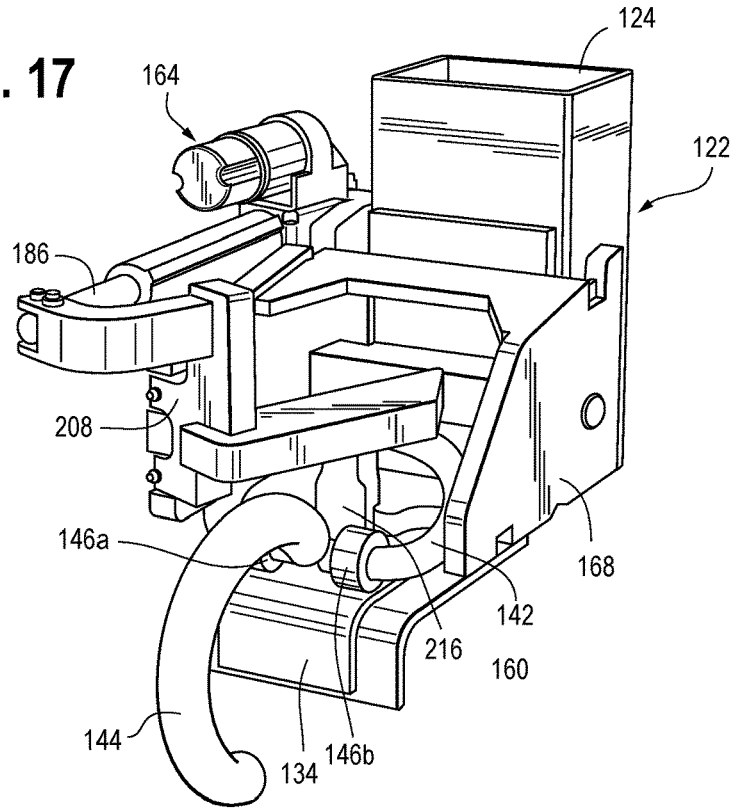
FIG. 17 depicts a perspective view of the load engagement mechanism of the barge lid lifter system in a landed and latched position on a barge lid lifting assembly.

Referring to FIG. 17, when the load engagement mechanism 122 of the barge lid lifter system 100 is in the landed and latched position, the shaft 186 of the linear actuator 164 is extended, the rotation plate 208 is nonparallel in relation to the first side plate 166, and the arm 160 is closed over the flat, top surface 226 of the dagger point 216.

In the illustrated embodiment, the arm 160 rotates approximately 70 degrees from the unlatched position to the latched position. In other embodiments the arm 160 may rotate only 45 degrees or greater than 180 degrees to reach a latched position. In the illustrated embodiment, the arm 160 has a thickness that is substantially constant over the length of the arm 160. In other embodiments the arm may have a curved shape and may have a thickness that is not constant over the length of the arm.

As the shaft 186 of the linear actuator 164 is extended, the arm 160 contacts the lifting eye 142 of the movable portion 138 of the barge lid lifting assembly 134 and the movable portion 138 rotates in the eyelets 146*a*, 146*b* toward the vertical beam 124. As the movable portion 138 rotates, the lifting eye 142 is retained below the arm 160, and the clamp portion 144 is raised out from under the barge lid 132.

The extension of the shaft 186 of the linear actuator 164 may accomplish three distinct actions with one motion. Extension of the linear actuator 164 rotates the rotation plate 208 and simultaneously, 1) rotates the movable portion 138 of the barge lid lifting assembly 134 up and toward the vertical beam 220, 2) unclamps the clamp portion 144 from the barge 150, and 3) secures the lifting eye 142 to the load engagement mechanism 122. The reverse is true when the linear actuator 164 is moved to an unextended position. As the shaft 186 retracts into the cylinder 184, three events take place: 1) the movable portion 138 of the lifting assembly 134 is rotated down and away from the vertical beam 220, 2) the clamp portion 144 is clamped to the barge 150, and 3) the lifting eye 142 is disengaged from the load engagement mechanism 122. All four barge lid lifting assemblies 134*a*-134*d* may be engaged by the load engagement mechanisms 122*a*-122*d* simultaneously or sequentially.

Each linear actuator comprises a sensor that determines the status of cylinder. When the cylinder is extended, the load engagement mechanism is latched, and when the cylinder is retracted (unextended) the load engagement mechanism is unlatched.

Figure 18:
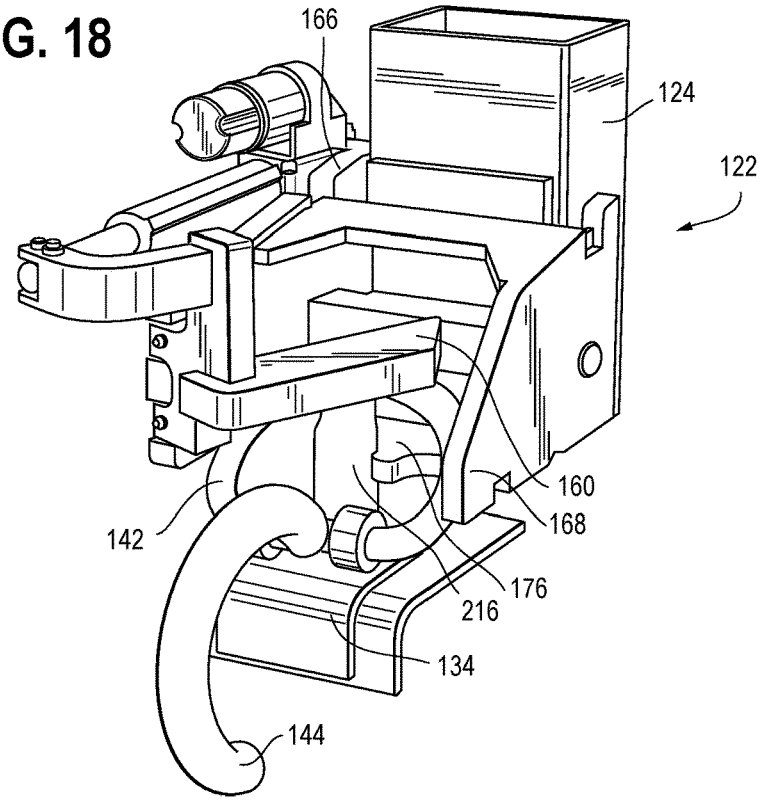
FIG. 18 depicts a perspective view of the load engagement mechanism of the barge lid lifter system in an unlanded and latched position on a barge lid lifting assembly.

Referring to FIG. 18, when the load engagement mechanism 122 of the barge lid lifter system 100 is latched onto the barge lid lifting assembly 134 and lifting the barge lid 132, the load engagement mechanism 122 is in an unlanded and latched position. In this position, the lifting eye 142 contacts the dagger point 216 and the dagger plate 176, and the barge lid 132 hangs from the load engagement mechanism 122.

Figure 19:
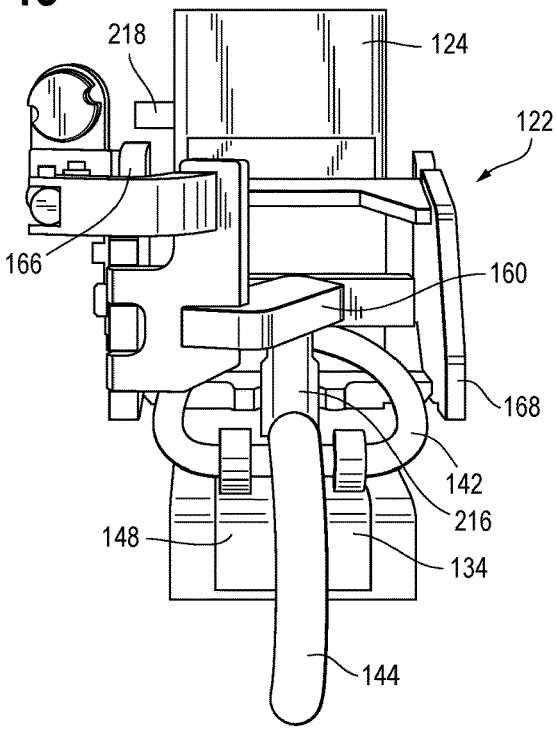
FIG. 19 depicts a front perspective view of the load engagement mechanism of the barge lid lifter system in the unlanded and latched position on a barge lid lifting assembly.

Referring to FIG. 19, when the load engagement mechanism of the barge lid lifter system 100 is in an unlanded and latched position, the dagger point 216 is no longer in contact with the upper plate 148 of the barge lid lifting assembly and no gap exists between the first side plate and the block 218.

Figure 20:
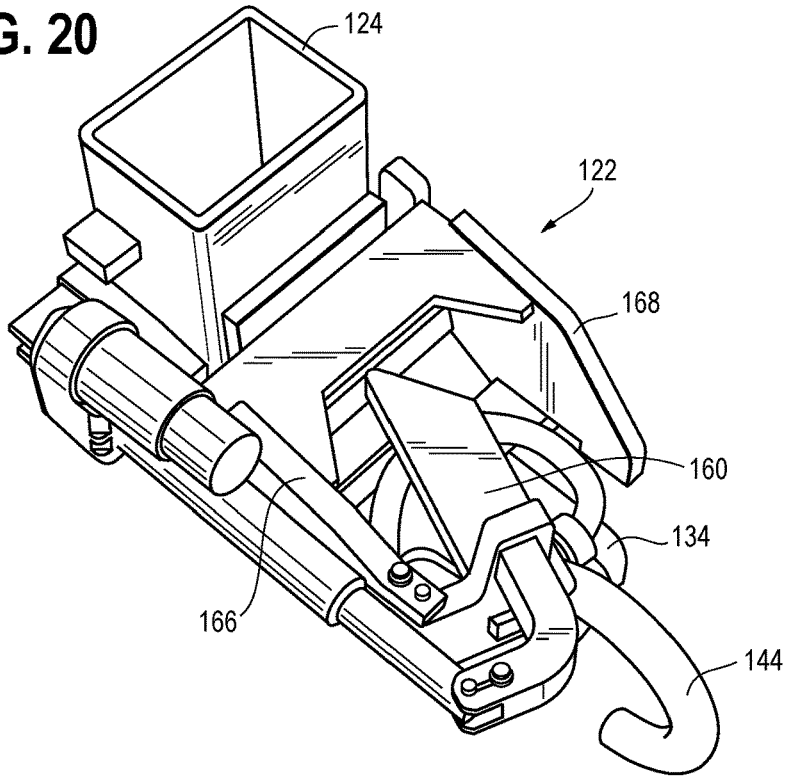
FIG. 20 depicts a top perspective view of the load engagement mechanism of the barge lid lifter system in the unlanded and latched position on a barge lid lifting assembly.

Referring to FIG. 20, when the load engagement mechanism 122 of the barge lid lifter system 100 is in an unlanded and latched position, the arm 160 extends over the dagger point 216 and the lifting eye 142 toward the vertical plate 124.

Figure 21:
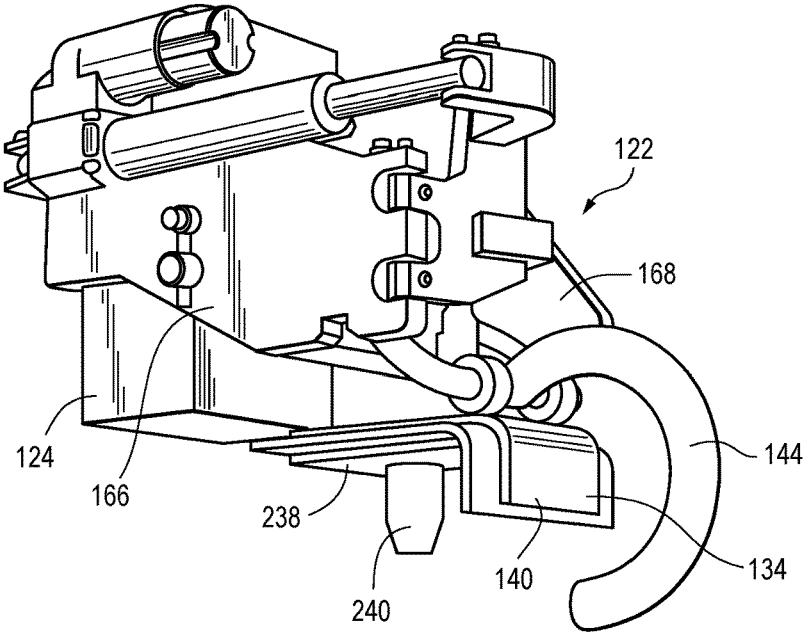
FIG. 21 depicts a bottom perspective view of the load engagement mechanism of the barge lid lifter system in the unlanded and latched position on a barge lid lifting assembly.

Referring to FIG. 21, when the load engagement mechanism 122 of the barge lid lifter system 100 is viewed from below, the lower plate 238 of the fixed portion 140 of the barge lid lifting assembly 134 is visible. The locator pin 240 is attached to the lower plate 238 of the fixed portion 140 of the barge lid lifting assembly 134 and helps to guide the barge lid 132 into place on the flange 156 located at either sidewall 158 of a barge 150 (shown in FIGS. 6-7).

Figure 22:
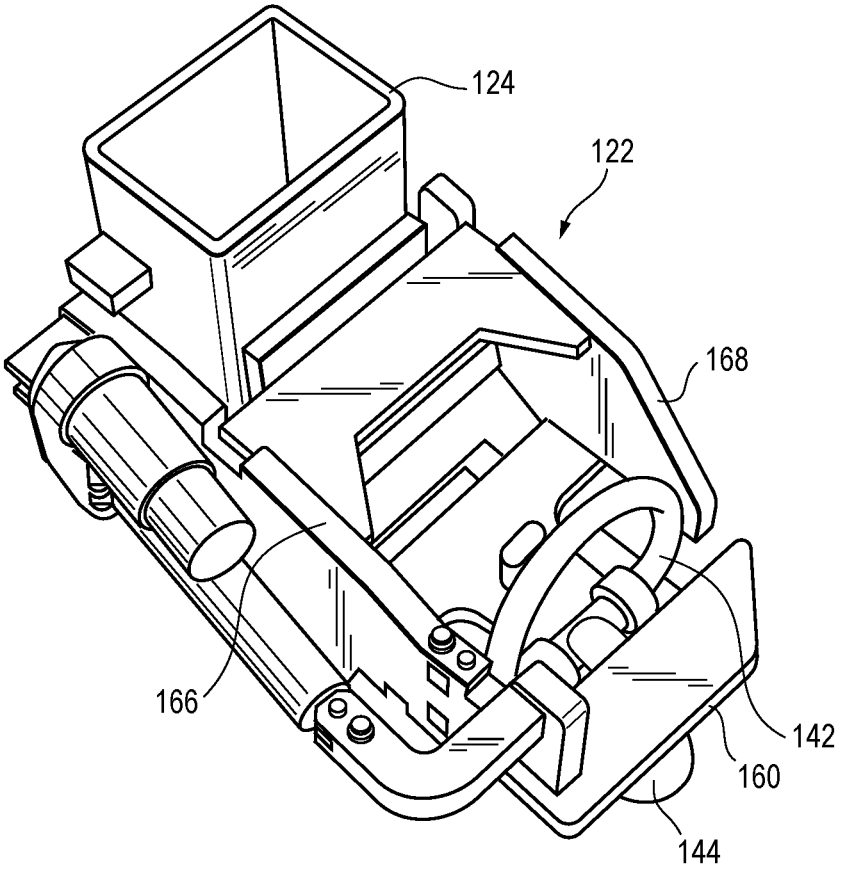
FIG. 22 depicts a top perspective view of the load engagement mechanism of the barge lid lifter system in the landed and unlatched position from a barge lid lifting assembly.

Referring to FIG. 22, when the load engagement mechanism 122 of the barge lid lifter system 100 is in a landed and unlatched position, the lifting eye 142 is in a substantially vertical position and the clamp portion 144 is in a lowered position.

Figure 23:
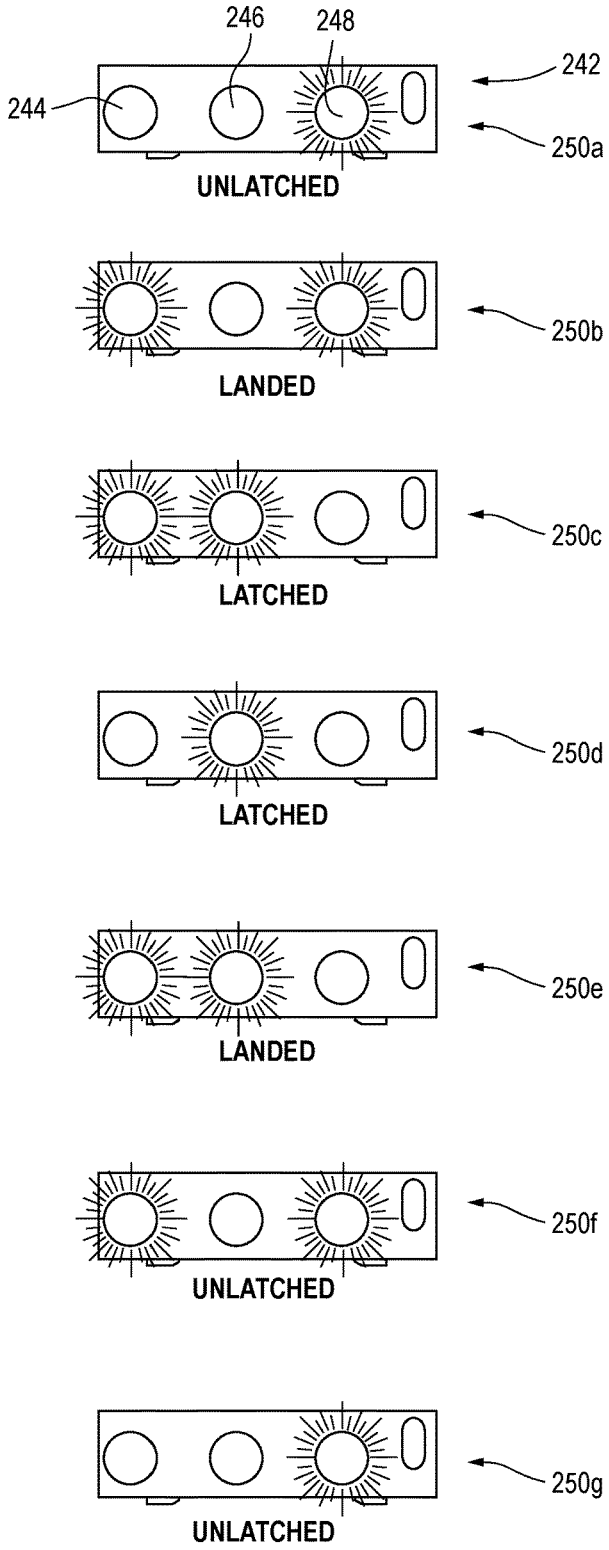
FIG. 23 depicts a plurality of indication lights showing an example of the status of the barge lid lifter system throughout the process of lifting a barge lid.

Referring to FIG. 23, the barge lid lifter system 100 includes a plurality of indication lights 242 comprising three round lights arranged in a row. A first light 244 is yellow and becomes illuminated when all four of the load engagement mechanisms 122*a*-122*d* are landed. If any of the load engagement mechanisms 122*a*-122*d* is in an unlanded position, this light is off. The landed status is sensed by one or more proximity switches (not shown) which are mounted on the first side panel 166 or on the vertical beam 124. In an unlanded position the block 218 comes into contact with the first side panel 166. In a landed position, a gap (not shown) exists between the block 216 and the first side panel 216. A proximity sensor on the vertical beam 124 is used to determine when the first side panel 166 is in close proximity to the block and give a signal that the load engagement mechanism 122 is in an unlanded position. The proximity sensor determines when the first side panel 166 is not in close proximity to the block 218 and gives a signal that the load engagement mechanism 122 is in a landed position.

A second light 246 is green and becomes illuminated when the shaft 186 of the linear actuator 164 is extended to signal a latched position. The second light 246 is off in an unlatched position. A third light 248 is red and is illuminated when the shaft 186 of the linear actuator 164 is unextended to signal an unlatched position. The status of the linear actuator 164 is sensed by limit switches inside the linear actuator that are connected to the communication portion 180. The latched or unlatched status is communicated to the PLC which controls the indication lights 242.

As the barge lid lifter system 100 is moved into position, each load engagement mechanism 122 is in the unlanded and unlatched position. The first indication light status 250*a* shows an unlanded and unlatched position. The yellow and green lights are off, and the red light is illuminated (in each successive status shown in FIG. 23 (250*a*-250*g*): the first light, when illuminated, is yellow; the second light, when illuminated, is green; and the third light, when illuminated, is red). The second indication light status 250*b* shows a landed and unlatched position. The yellow and red lights are illuminated, and the green light is off. The third indication light status 250*c* shows a landed and latched position. The yellow and green lights are illuminated, and the red light is off. The fourth indication light status 250*d* shows an unlanded and latched position. The green light is illuminated, and the yellow and red lights are off. The fifth indication light status 250*e* shows a landed and latched position. The yellow and green lights are illuminated, and the red light is off. The sixth indication light status 250*f* shows a landed and unlatched position. The yellow and red lights are illuminated, and the green light is off. The seventh indication light status 250*g* shows an unlanded and unlatched position. The yellow and green lights are off, and the red light is illuminated.

Figure 24:
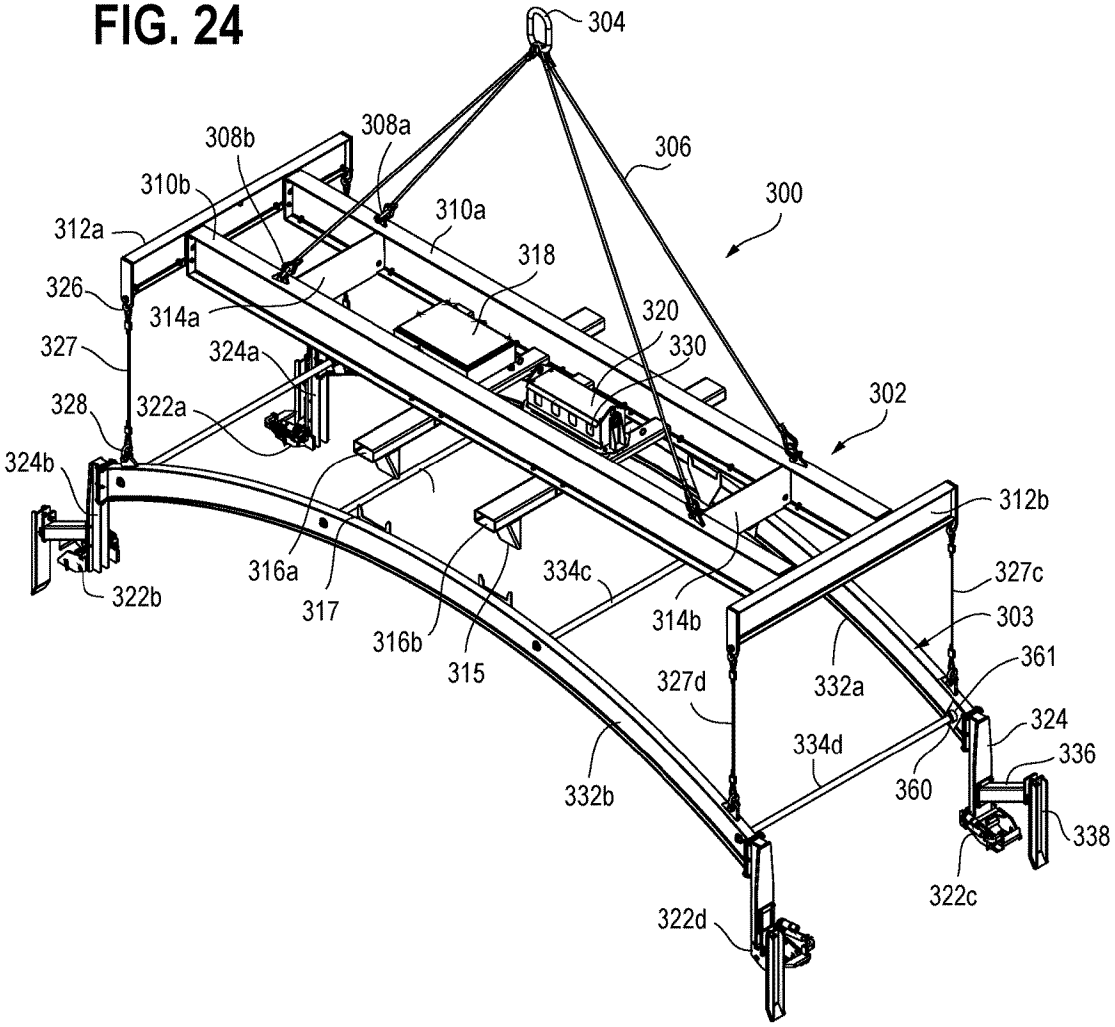
FIG. 24 depicts a perspective view of a second embodiment of a barge lid lifter system.

Referring to FIG. 24, a second example embodiment of a barge lid lifter system 300 is shown. This second embodiment is provided with reference numerals that track like structures in the first embodiment, the first embodiment denoted by 100 series reference numerals and the second embodiment denoted by 300 series reference numerals.

The barge lid lifter system 300 includes an upper frame 302 connected to an oblong link 304 using a cable bridle 306, and a lower frame 303 connected to the upper frame 302 by a plurality of cables 327*a*-327*d*. The oblong link 304 can be attached to a crane hook (not shown) or other lifting means. The illustrated embodiment shows cable anchor points 308*a*, 308*b*, 308*c*, 308*d* attached to the upper frame 302. The oblong link 304 is configured to accept a hook suspended from a crane or an overhead hoist. Alternate embodiments may include a frame with different anchor points configured to accept plate lifters, grapplers, container spreaders and other lifting systems for lifting balanced or unbalanced loads when weight is distributed over several points.

When the barge lid lifter system 300 is landed on a barge lid, the lower frame rests on the barge lid, which creates slack in one or more of the cable that join the upper frame and the lower frame. This two-piece frame allows the crane to support the upper frame such that only the weight of the lower frame needs to be supported by the barge lid.

The upper frame 302 includes two side beams 310*a*, 310*b* and two end beams 312*a*, 312*b*. Horizontal bracing plates 314*a*-314*b* provide support between the side beams and end beams, and horizontal bracing beams 316*a*-316*b* are provided between the side beams 310*a*, 310*b*. A first housing 318 and a second housing 320 are mounted between horizontal side bracing beams 316*a*-316*b* of the upper frame 302. The first housing 318 contains a remote transmitter control system and is preferably water-tight to protect the remote transmitter control system from the elements. The remote transmitter control system includes relays, a programmable logic controller (PLC), radio communication equipment, and wiring. The second housing 320 contains a battery system to power the remote transmitter control system and the load engagement mechanisms 322*a*-322*d* of the barge lid lifter system 300. Other means of providing power to the barge lid lifter system 100 may include pneumatic power, hydraulic power, and mechanical power.

Indication lights 330 are provided on the sides and/or ends of the horizontal frame 302 to communicate the status of the load engagement mechanisms 322*a*-322*d* to crane operators, dock workers, and others working on land.

The lower frame 303 comprises two curvilinear side beams. The curvilinear side beams include upper anchor points 328*a*-328*d* and are joined by connecting rods 334*a*-334*d*. The ends of the connecting rods are retained in spherical bearings mounted on the curvilinear side beams. Each bearing housing 360 is mounted by a bearing housing support plate 361 that is welded to the upper and lower flanges of the curvilinear side beam 332. See FIG. 29. Four vertical beams 324*a*-324*d* are mounted on the four corners of the lower frame 303. Each load engagement mechanism 322 is mounted to the bottom of each vertical beam 324.

Figure 25:
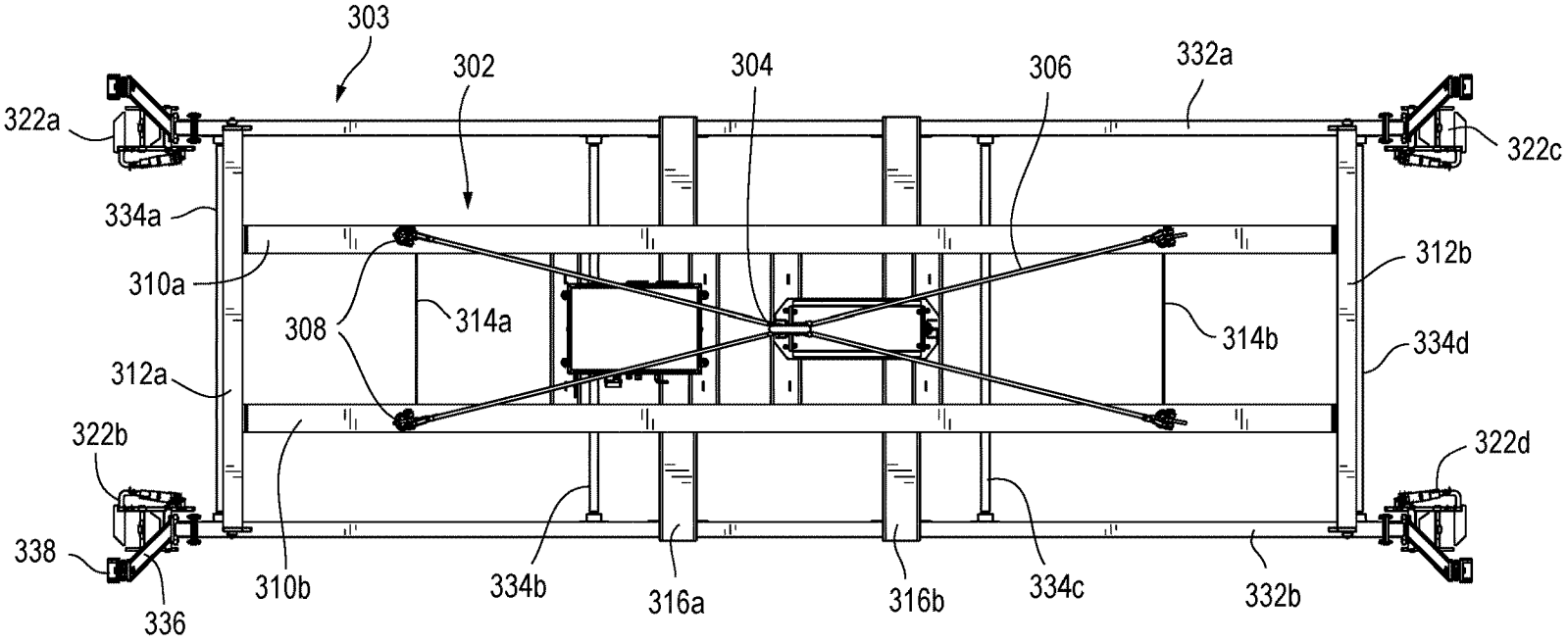
FIG. 25 depicts a top view of the barge lid lifter system of FIG. 24.

Referring to FIG. 25, a top view of the barge lid lifter system 300 is shown. The upper frame 302 has a rectangular shape comprising two side beams 310*a*, 310*b* and two end beams 312*a*, 312*b*. The load engagement mechanisms 322*a*-322*d* are located below each corner of the lower frame 303. Power cables and communication wiring (not shown) are run between the first housing 318, the second housing 320, and the load engagement mechanisms 322*a*-322*d*.

Figure 26:
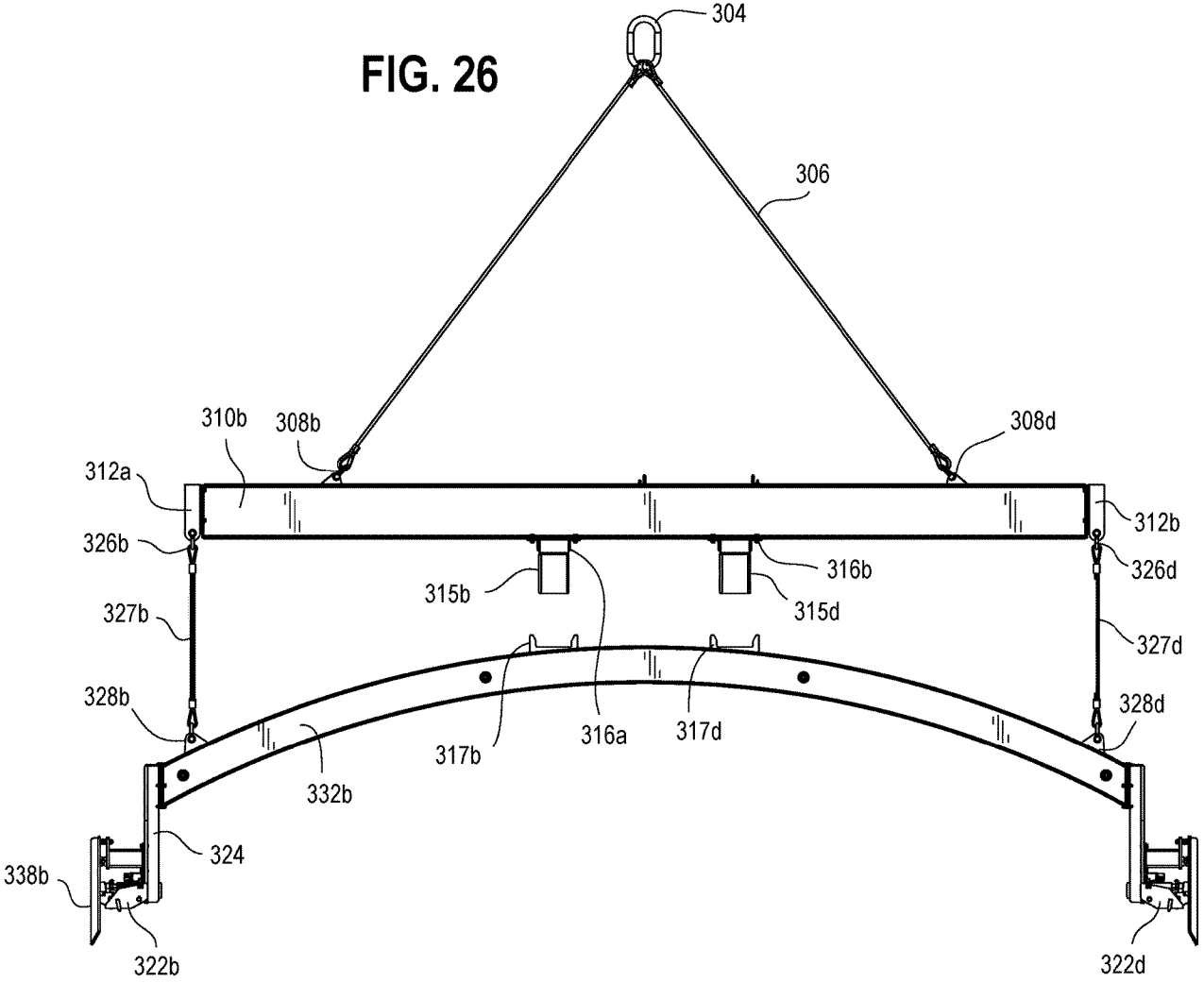
FIG. 26 depicts a side view of the barge lid lifter system.

Referring to FIG. 26, a side view of the barge lid lifter system 300 is shown. The guides are mounted to the bracing beams 316*a*-316*b* of the upper frame 302 above the stops 317*a*, 317*b* on the lower frame 303.

Figure 27:
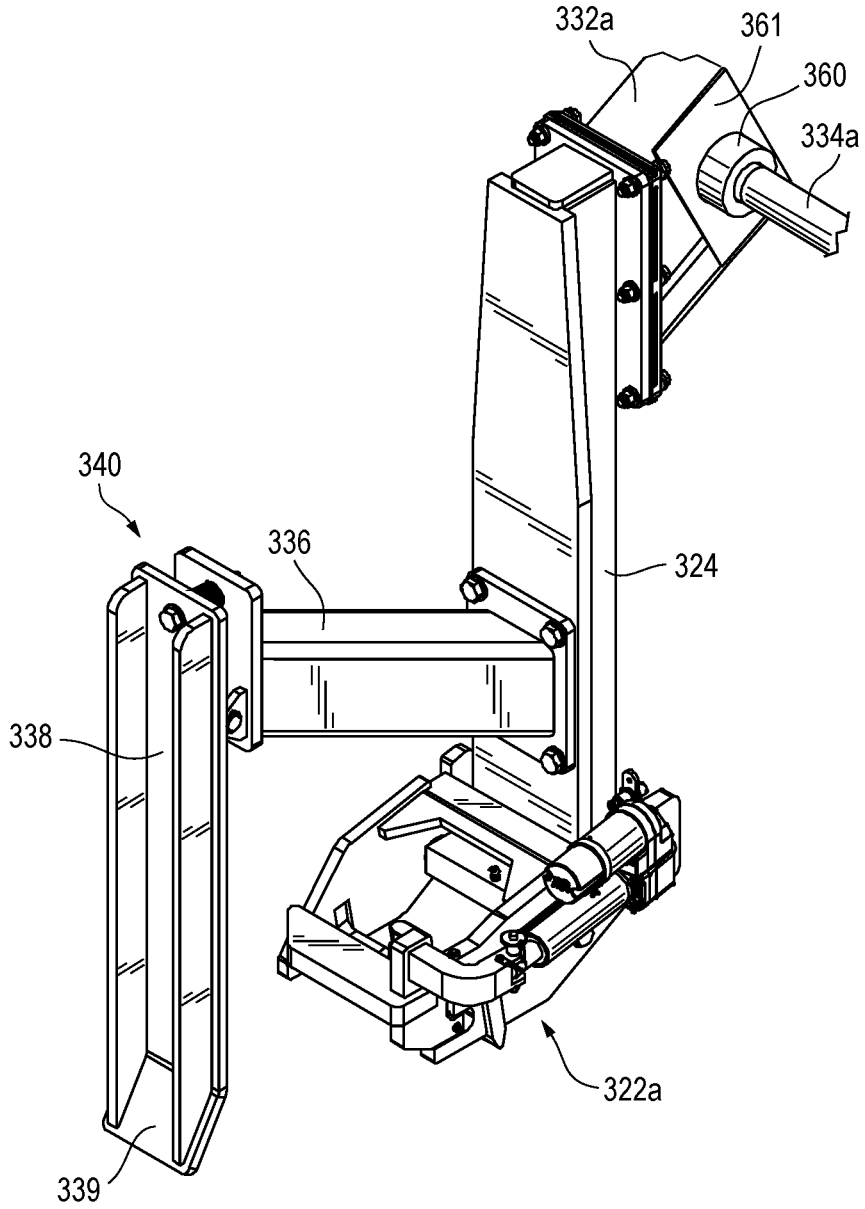
FIG. 27 depicts a load engagement mechanism having a vertical guide system.

Referring to FIG. 27, a perspective view of a vertical guide is shown. The barge lid lifter system 300 includes a plurality of vertical guides for positioning the load engagement mechanisms over the four lifting assemblies positioned at either of a barge lid. The lower frame 303 is designed to engage each of the four lifting assemblies. The side beams 310*a*, 310*b* are approximately 30 feet long and the connecting rods 334*a*-334*d* are approximately 9 feet long. The connecting rods are welded to rod end portions that are each retained in a spherical bearing. The bearing housings 360 are each welded to a bearing housing support plate 361 which is mounted to the inside of the side beams 332.

An operator uses a crane to position the barge lid lifter system 300 so that the load engagement mechanisms 322*a*-322*d* are positioned over each of the barge lid lifting assemblies located on the either edge of the barge lid. Once in position, an operator will verify the status of the load engagement mechanisms 322*a*-322*d* (unlatched). The worker may lower the barge lid lifter system 300 down onto the barge lid once all four of the load engagement mechanisms are verified to be in the unlatched position.

A guide system is provided on the lower frame 303. Each guide post 338 may be bolted onto and extend outward from each vertical beam 324 of the lower frame 303 to align the barge lid lifter system 100 with the sides 152, 154 of a barge 150. A vertical guide is attached to each guide post via a spring system 340 which includes a spring and a hinge.

Figure 28:
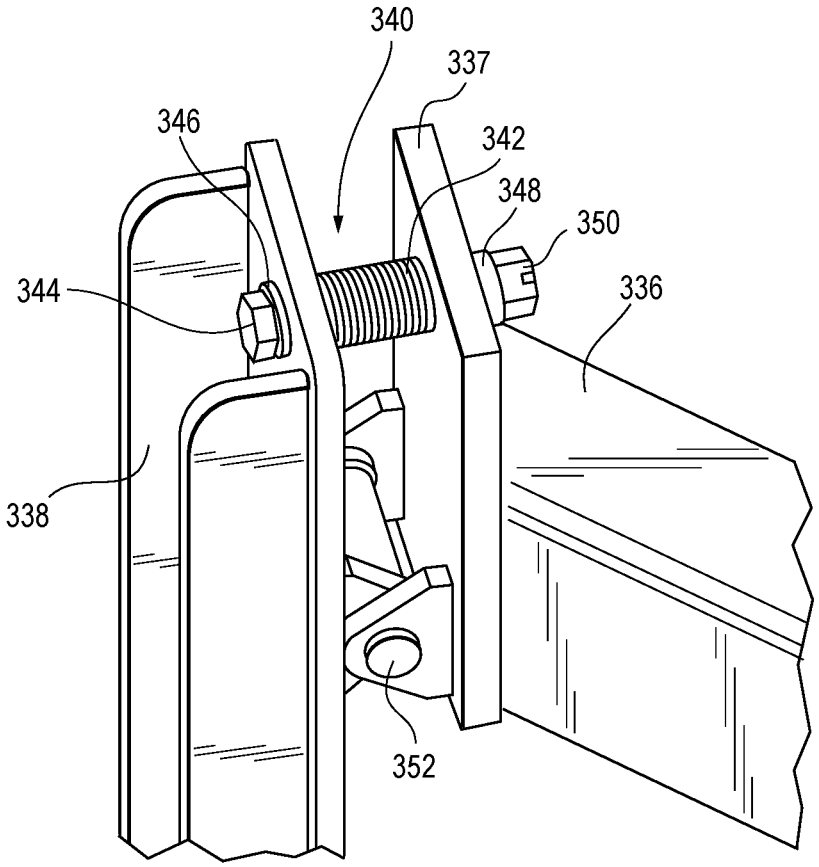
FIG. 28 depicts a spring system of the vertical guide system of FIG. 27.

Referring to FIG. 28, the vertical guide systems include a guide post 336 with a bracket 337. The lower portion of each vertical guide 338 forms an angular portion 339. The angular portion is sloped such that when the angular portion contacts the edge of a barge lid, the lower portion of the vertical guide moves outward and the spring is compressed. The vertical guide is located on the opposite side of the load engagement mechanism as the linear actuator so that it does not interfere with the movement of the arm as the arm moves over the dagger point to latch the lifting eye of a barge lid. The vertical guide system includes a spring system 340 and a hinge.

The spring system 340 includes a bolt 344 mounted through the vertical guide 338 and the bracket 337. A spring 342 is mounted around the bolt 344 and may be compressed between the vertical guide and the bracket as the vertical guide moves in relation to the bracket which in turn causes movement about the hinge. A spacer 348 and a nut 350 are mounted on the bolt 344 to adjust the spring system 340. The hinge includes a hinge pin 352 that is retained in a set of lugs 354*a*, 354*b* mounted to the vertical guide 338 and a set of lugs 353*a*, 353*b* mounted to the bracket 337. A spring is retained in a bolt above the hinge. A castle nut 350 secures a spacer 348 (or a series of flat washers) on the bolt 344.

Figure 29:
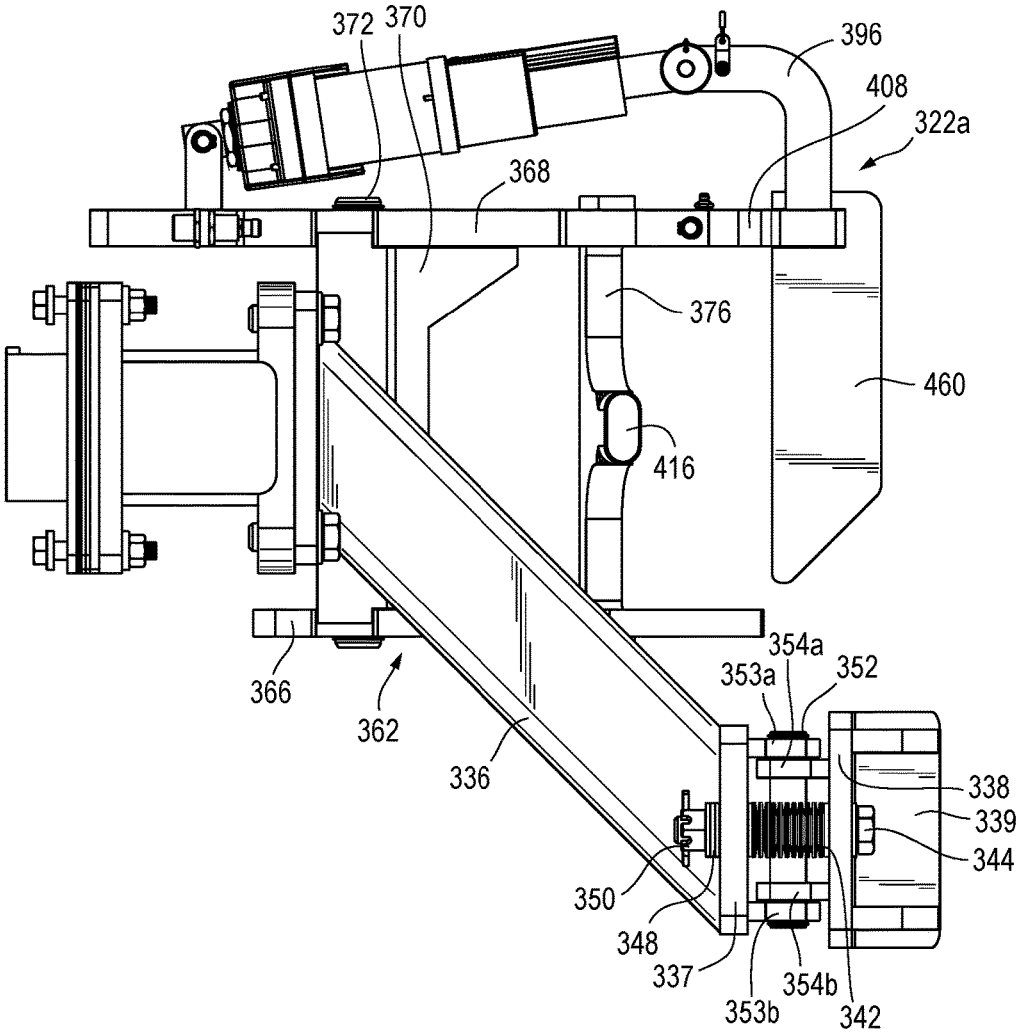
FIG. 29 depicts a top view of the load engagement mechanism having a vertical guide system.

Referring to FIG. 29, a top view of a load engagement mechanism and vertical guide is shown. Rather than extending out over the load engagement mechanism (the guide post extends away from the lower frame and the load engagement mechanism at an angle such that it does not interfere with the movement of the arm 460. The angle of the guide post in relation to the vertical guide is preferably between about 30° and about 60°, most preferably about 45°. In the illustrated embodiment, the spring 342 is comprised of approximately 15-25 Belleville washers arranged in an alternating pattern with one flat washer at either end. The Belleville washers function as a spring that is compressed when the vertical guide contacts the side of a barge lid. The position of the vertical guide is adjustable by adding or removing flat washers from the spring system. The castle nut 350 functions as a locking device. The bolt may have one or more holes through which a cotter pin may be inserted. The cotter pin may engage the crenellated portions of the castle nut to prevent the nut 350 from becoming loosened.

Figure 30:
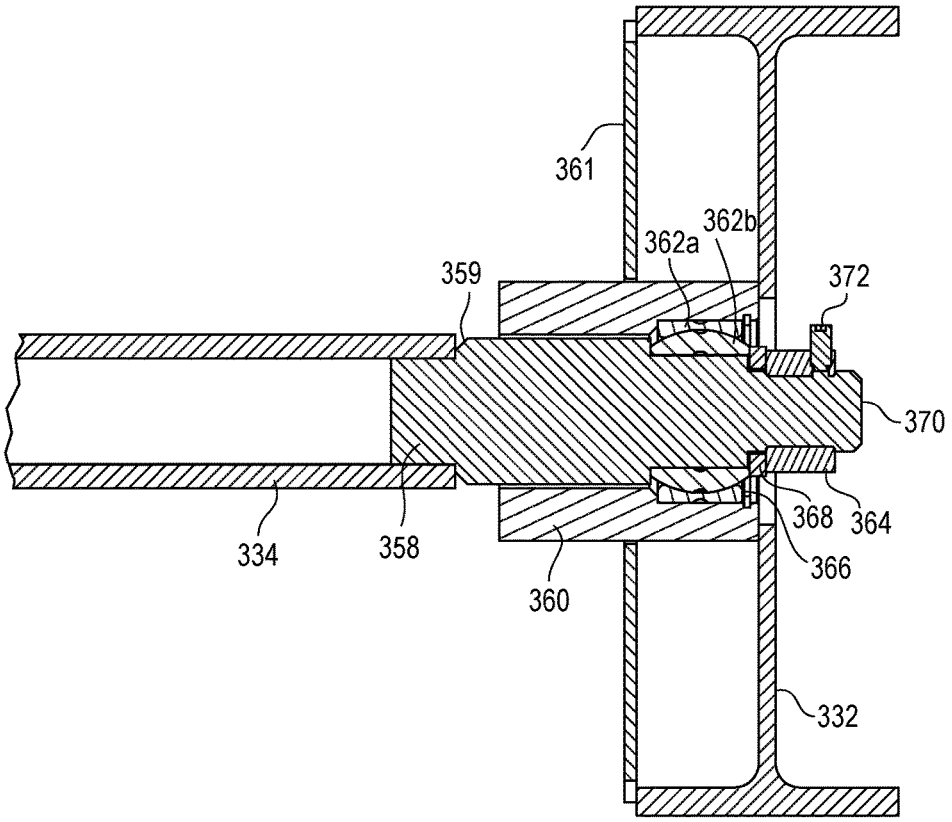
FIG. 30 depicts a cross sectional view of a connecting rod and spherical bearing of the second embodiment of the barge lid lifter system.

Referring to FIG. 30, each of the connecting rods 334 of the lower frame comprises an intermediate portion that is hollow and welded to rod end portions 358. At each rod end portion 358, the rod end is retained in a spherical bearing 362 inside a bearing housing 360 that is mounted or welded to the curvilinear side beam 332 and a bearing housing support plate 361 that is welded to the upper and lower flanges of the curvilinear side beam 332. The spherical bearing housing retains the outer portion 362*a* and the inner portion 362*b* of the spherical bearing. The rod end portions extend through the side beams and are retained by a nut 364 having a set screw 372. The rod end surface extends on the outside of the side beam and this outer portion of the rod end portion 358 has a smaller diameter than the connecting rod 334. The spherical bearings allow rotational movement between the connecting rods and the side beams. Over the nine foot length of each connecting rod, the rotational movement in the spherical bearings results in about 2 to 10 inches in relation to a direction normal to the interior surface of the curvilinear side beam. This independent movement allows the lower frame to be semi-rigid.

The embodiment(s) detailed above may be combined, in full or in part, with any alternative embodiment(s) described.

INDUSTRIAL APPLICABILITY

Important advantages of the barge lid lifter system include load engagement mechanisms that use arms to retain the lifting eyes of barge lid lifting assemblies, linear actuators for deploying the arms, and a horizontal frame capable of hoisting a barge lid. Another important advantage of the lift beam system is the combination of remote communication to verify the status of load engagement mechanisms and remote latching to engage barge lid lifting eyes without putting a dock worker over water.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Various embodiments of this disclosure are described herein, including the best mode known to the inventors for carrying out the disclosure. It should be understood that the illustrated embodiments are exemplary only, and should not be taken as limiting the scope of the disclosure.

We claim:

1. A barge lid lifter system comprising:

a horizontal frame, communication equipment indication lights mounted to the horizontal frame, a plurality of vertical beams connected to the horizontal frame, and a load engagement mechanism mounted to each of the plurality of vertical beams;

wherein each load engagement mechanism comprises a mechanism frame, the mechanism frame comprising a first side panel, a second side panel, a top plate, and a dagger plate, wherein each load engagement mechanism is configured to retain a lifting eye of a barge lid lifting assembly using a linear actuator, an arm, and a dagger point; and wherein the linear actuator is configured to rotate the arm over the dagger plate to retain the lifting eye of the barge lid.

2. The barge lid lifter system of claim 1 wherein the linear actuator of each of the load engagement mechanisms is mounted to the mechanism frame.

3. The barge lid lifter system of claim 1 wherein a vertical guide system is mounted to each vertical beam, the vertical guide system comprising a guide post mounted to the vertical beam, and a vertical guide mounted to the guide post.

4. The barge lid lifter system of claim 3 wherein each guide post is mounted to each vertical guide by a spring system, the spring system including a spring retained in a bolt and a hinge pin retained between two sets of lugs.

5. A barge lid lifter system comprising:

a horizontal frame, communication equipment indication lights mounted to the horizontal frame, a plurality of vertical beams connected to the horizontal frame, and a load engagement mechanism mounted to each of the plurality of vertical beams;

wherein each load engagement mechanism comprises a mechanism frame, the mechanism frame comprising a first side panel, a second side panel, a top plate, and a dagger plate, wherein each load engagement mechanism is configured to retain a lifting eye of a barge lid lifting assembly using a linear actuator, an arm, and a dagger point;

wherein the horizontal frame comprises an upper frame and a lower frame, the upper frame having one or more lifting lugs and a plurality of lower lifting lugs, the lower frame comprising a plurality of upper lifting lugs and the plurality of vertical beams; and wherein the upper frame and the lower frame are joined by a plurality of cables.

6. The barge lid lifter system of claim 2 wherein the lower frame is comprised of curvilinear side beams joined by a plurality of connecting rods.

7. The barge lid lifter system of claim 6 wherein side beams of the upper frame include guides and the curvilinear side beams of the lower frame include stops positioned beneath the guides of the upper frame.

8. The barge lid lifter system of claim 6 wherein the connecting rods are retained in spherical bearings mounted on the curvilinear side beams.

9. A barge lid lifter system comprising:

a load engagement mechanism comprising a mechanism frame, the mechanism frame comprising a first side panel, a second side panel, a top plate, a dagger plate, a horizontal pivot pin, and a horizontal pivot pin sleeve; and a linear actuator of the load engagement mechanism, the linear actuator configured to position an arm over a dagger point on the dagger plate.

10. The barge lid lifter system of claim 9 wherein the linear actuator includes a rear portion that is mounted to a rear bracket and a forward portion retained in a forward bracket mounted to a rotation plate.

11. The barge lid lifter system of claim 10 wherein the arm is mounted to the rotation plate.

12. The barge lid lifter system of claim 10 further comprising a first sensor configured to sense rotation about the horizontal pivot pin, the first sensor being a proximity sensor.

13. The barge lid lifter system of claim 12 further comprising a second sensor configured to sense the status of the linear actuator, the second sensor comprising one or more limit switches.

14. The barge lid lifter system of claim 13 wherein the plurality of indication lights are in communication with the second sensor.

15. The barge lid lifter system of claim 12 comprising a plurality of indication lights in communication with the first sensor.

16. A method of lifting a barge lid comprising the steps of:

landing a barge lid lifter system onto a barge lid, the barge lid lifter system having an upper frame and a lower frame joined by a plurality of cables, the lower frame comprising a plurality of load engagement mechanisms, wherein a plurality of lifting eyes of the barge lid are positioned between a dagger point and an arm of each of the plurality of load engagement mechanisms; and latching each of the plurality of barge lid lifting eyes, wherein each of the arms of the plurality of load engagement mechanisms close over each of the dagger points to retain the plurality of lifting eyes of the barge lid.

17. The method of claim 16 wherein the step of landing further comprises creating slack in one or more of the plurality of cables that join the upper frame and the lower frame of the barge lid lifter system.

18. The method of claim 17 further comprising verifying that the plurality of load engagement mechanisms are landed and latched prior to lifting the barge lid lifter system.

19. The method of claim 16 further comprising lifting the barge lid lifter system, wherein the load engagement mechanisms are unlanded from the barge lid, and the barge lid is lifted off of a barge.

20. The method of claim 16 further comprising verifying that the plurality of load engagement mechanisms are landed prior to latching each of the plurality of barge lid lifting eyes.

* * * * *